US009531092B2

(12) United States Patent
Wada et al.

(10) Patent No.: US 9,531,092 B2
(45) Date of Patent: Dec. 27, 2016

(54) TERMINAL AND CONNECTION STRUCTURE USING TERMINAL

(71) Applicant: J.S.T. MFG. CO., LTD., Osaka-shi (JP)

(72) Inventors: Masato Wada, Osaka (JP); Kensuke Takahashi, Osaka (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 14/903,143

(22) PCT Filed: May 14, 2014

(86) PCT No.: PCT/JP2014/062898
§ 371 (c)(1),
(2) Date: Jan. 6, 2016

(87) PCT Pub. No.: WO2015/004986
PCT Pub. Date: Jan. 15, 2015

(65) Prior Publication Data

US 2016/0190714 A1 Jun. 30, 2016

(30) Foreign Application Priority Data

Jul. 11, 2013 (JP) ..... 2013-145928

(51) Int. Cl.
*H01R 12/00* (2006.01)
*H01R 12/53* (2011.01)
(Continued)

(52) U.S. Cl.
CPC ..... *H01R 12/53* (2013.01); *H01R 4/185* (2013.01); *H01R 12/58* (2013.01)

(58) Field of Classification Search
CPC ..... H01R 12/53; H01R 4/185; H01R 12/58; H01R 4/18
(Continued)

(56) References Cited

U.S. PATENT DOCUMENTS 7,384,318 B2 * 6/2008 Lamdiziz ..... H01R 13/4368 439/816
7,473,111 B2 * 1/2009 Konishi ..... H01R 12/58 439/82
(Continued)

FOREIGN PATENT DOCUMENTS

CN 102480835 A 5/2012
GB 2280991 A 2/1995
(Continued)

OTHER PUBLICATIONS

PCTJP2014062898; Notification of Transmittal of the International Preliminary Report on Patent Ability—PCT/IB/338; dated Jan. 21, 2016 (1 page).
(Continued)

*Primary Examiner* — Javid Nasri
(74) *Attorney, Agent, or Firm* — Kratz, Quintos & Hanson, LLP

(57) ABSTRACT

A terminal includes a body portion formed in a major arc cylindrical shape in which a gap is formed between two edges in the circumferential direction or an overlapping cylindrical shape in which the two edges in the circumferential direction overlap each other, such that a cylindrical space is formed inside the body portion, and locking portions disposed on at least one side out of the back side and the front side in the insertion direction of the body portion and having base pieces that extend from the body portion toward the back side in the insertion direction or the front side in the insertion direction and locking pieces that are provided on the base pieces. The body portion has at least
(Continued)

one projecting portion projecting toward the outside. A connection structure includes the terminal, a connected object and a mounting member. It is possible to cause the terminal to which the connected object is attached to stand on its own relative to the mounting member, and to ensure the thickness of a solder layer between the terminal with the connected object and a through hole.

10 Claims, 21 Drawing Sheets

(51) Int. Cl.
*H01R 12/58* (2011.01)
*H01R 4/18* (2006.01)

(58) Field of Classification Search
USPC ..... 439/816, 82, 83
See application file for complete search history.

(56) References Cited

U.S. PATENT DOCUMENTS

| | | | |
|---|---|---|---|
| 2008/0144301 | A1 | 6/2008 | Konishi |
| 2012/0127681 | A1 | 5/2012 | Ryu |

FOREIGN PATENT DOCUMENTS

| | | | |
|---|---|---|---|
| JP | S54-119665 | U | 8/1979 |
| JP | S57-203474 | U | 12/1982 |
| JP | S61-178271 | U | 11/1986 |
| JP | H04-121674 | U | 10/1992 |
| JP | H05-343115 | A | 12/1993 |
| JP | 2008-153137 | A1 | 7/2008 |
| JP | 2012-114394 | A1 | 6/2012 |
| KR | 10-2012-0056128 | A | 6/2012 |

OTHER PUBLICATIONS

PCTJP2014062898; International Preliminary Report on Patentability/Written Opinion—PCT/IB/373; dated Jan. 12, 2016 (13 pages) with Translation.

PCTJP2014062898; Notification Concerning Transmittal of International Preliminary Report on Patentability—PCT/IB/326; dated Jan. 21, 2016 (1 page).

International Search Report for International Application No. PCT/JP2014/062898 dated Aug. 5, 2014 (4 Sheets).

Written Opinion of the International Searching Authority for International Application No. PCT/JP2014/062898 dated Aug. 5, 2014 (5 Sheets).

* cited by examiner

TERMINAL AND CONNECTION STRUCTURE USING TERMINAL

TECHNICAL FIELD

The present invention belongs to a technical field of a terminal, and relates to a terminal for connecting a connected object having a rod-shaped conductor to a mounting member, and a connection structure using the terminal.

BACKGROUND ART

JP 2008-153137A discloses a connecting terminal for a printed substrate that does not require soldering and a printed substrate unit. A lead terminal is received in a space in the connecting terminal. A tip end of an elastic displacing piece applies an elastic force toward a central axis of a cylindrical space. The elastic displacing piece comes into strong contact with the lead terminal. An electrical connection is established between the lead terminal and the elastic displacing piece. Meanwhile, a blade portion bites into an inner wall surface of a through hole of a printed wiring substrate. An electrical connection is established between the blade portion and the through hole. Thus, an electrical connection is established between the lead terminal and the through hole. With the connecting terminal, an electronic component is mounted on the printed wiring substrate by merely inserting the lead terminal into the through hole. All the lead terminals are fixed to the printed wiring substrate with a force of a single press. Soldering is omitted.

JP H5-343115A discloses a substrate attachment terminal whose structure is simplified. This substrate attachment terminal includes an electrical contact portion and an attachment portion to be attached to a wiring substrate. Side walls that are opposed to a substrate portion rise in the attachment portion, and each of the side walls is provided with an attachment leg piece that projects toward the outside of the substrate portion. A pair of side walls that are opposed to each other or the attachment leg pieces are elastically displaced with respect to the substrate portion.

JP H4-121674U discloses a substrate direct attachment connector having a terminal to be connected to a wiring substrate by soldering. An object thereof is to prevent cracking of a solder portion due to thermal strain or the like, and to improve the workability of inserting a terminal pin portion into the wiring substrate. The connector includes a connector housing in which a plurality of terminal accommodating chambers are arranged, and a terminal in which an electrical contact portion for a partner terminal provided on one side is linked via a flexible portion to a pin portion for a through hole of a wiring substrate provided on the other side. A flexible holding portion for positioning the terminal with respect to the flexible portion is formed on the inner wall of the terminal accommodating chamber.

SUMMARY OF INVENTION

When a terminal to which an electric wire is connected is to be inserted into a through hole provided in a printed wiring board and is to be soldered to a land of the printed wiring board, a process is performed that includes a connecting step of connecting the electric wire to the terminal, a fitting step of fitting the terminal with the electric wire into a through hole of the printed wiring board, and a soldering step of soldering the terminal with the electric wire to a land of the printed wiring board.

If, in the fitting step, the terminal with the electric wire is not firmly fitted into the through hole, the terminal with the electric wire may become inclined with respect to the through hole, and in this case, the dimensions of a gap between the terminal with the electric wire and a wall constituting the through hole vary. Therefore, in the soldering step, the absorption of molten solder into the gap, that is, the so-called wetting of solder, becomes poor, and thus a solder layer may not be favorably formed in the gap. As a result, there is a risk that stable strength of the mechanical and electrical connection between the electric wire and the printed wiring board cannot be obtained. In order to prevent this, in the soldering step, the terminal with the electric wire, which has been fitted into the through hole, needs to be held so as not to be inclined, resulting in additional man-hours.

The present invention was made in light of such points, and an object thereof is to provide a terminal and a connection structure using the terminal that can solve the above-described problems.

In order to achieve the above-described object, a terminal of the present invention is a terminal that includes:

a body portion having conductivity and elasticity, and being formed in a major arc cylindrical shape in which a central angle is greater than 180 degrees and a gap is formed between two edges in a circumferential direction or an overlapping cylindrical shape in which two edges in the circumferential direction overlap each other, as viewed from an insertion direction, such that a cylindrical space whose generating line extends in the insertion direction is formed inside the body portion; and a locking portion being disposed on at least one side out of a back side and a front side in the insertion direction of the body portion, and having a base piece that extends from the body portion toward the back side in the insertion direction or the front side in the insertion direction and a locking piece that is provided on the base piece, wherein the body portion has at least one projecting portion projecting toward an outside.

The connected object is connected to the terminal by inserting the conductor of the connected object into the cylindrical space of the body portion and locking the connected object with the locking portion. Then, the body portion of the terminal with the connected object is inserted into the through hole of the mounting member and fitted into the through hole. In this case, since the body portion is formed in the major arc cylindrical shape or the overlapping cylindrical shape having elasticity and has the projecting portion, if the dimensions of the body portion including the projecting portion are controlled, the body portion including the projecting portion of the terminal with the connected object comes into contact with a wall constituting the through hole and is fitted into the through hole with a predetermined fitting force. Therefore, in the fitting step, the terminal with the connected object stands on its own relative to the mounting member, and a gap between the body portion of the terminal with the connected object and the wall constituting the through hole is ensured by the projecting portion. Accordingly, in the soldering step, capillary action or the like facilitates the wetting of solder in the gap, and a solder layer is favorably formed in the gap. This makes it possible to obtain stable strength of the mechanical and electrical connection between the connected object and the mounting member.

In the terminal of the present invention, the body portion of the terminal was formed in the major arc cylindrical shape or the overlapping cylindrical shape having elasticity and was provided with the projecting portion projecting toward the outside. This made it possible to provide a terminal with which the terminal to which the connected object is connected can be fitted into the through hole provided in the mounting member with a predetermined fitting force so that the terminal with the connected object stands on its own relative to the mounting member and the gap between the terminal with the connected object and the wall constituting the through hole is ensured in the fitting step, capillary action or the like can facilitate the wetting of solder in the gap so that the solder layer is favorably formed in the gap in the soldering step, and stable strength of the mechanical and electrical connection between the connected object and the mounting member can be obtained.

A connection structure using a terminal of the present invention is a connection structure using a terminal that includes:

a connected object having a rod-shaped conductor;

a mounting member provided with a through hole; and a terminal that includes:

a body portion having conductivity and elasticity, and being formed in a major arc cylindrical shape in which a central angle is greater than 180 degrees and a gap is formed between two edges in a circumferential direction or an overlapping cylindrical shape in which two edges in the circumferential direction overlap each other, as viewed from an insertion direction, such that a cylindrical space whose generating line extends in the insertion direction is formed inside the body portion; and a locking portion being disposed on at least one side out of a back side and a front side in the insertion direction of the body portion, and having a base piece that extends from the body portion toward the back side in the insertion direction or the front side in the insertion direction and a locking piece that is provided on the base piece, the body portion having at least one projecting portion projecting toward an outside, wherein the conductor of the connected object is inserted into an inside of the body portion and is locked to the locking portion, the body portion is fitted into the through hole of the mounting member, and the projecting portion is in contact with a wall constituting the through hole, and a solder layer is formed between the body portion and the wall constituting the through hole.

The connected object is connected to the terminal by inserting the conductor of the connected object into the cylindrical space of the body portion and locking the connected object with the locking portion. Then, the body portion of the terminal with the connected object is inserted into the through hole of the mounting member and fitted into the through hole. In this case, since the body portion is formed in the major arc cylindrical shape or the overlapping cylindrical shape having elasticity and has the projecting portion, if the dimensions of the body portion including the projecting portion are controlled, the body portion including the projecting portion of the terminal with the connected object comes into contact with the wall constituting the through hole and is fitted into the through hole with a predetermined fitting force. Therefore, in the fitting step, the terminal with the connected object stands on its own relative to the mounting member, and a gap between the body portion of the terminal with the connected object and the wall constituting the through hole is ensured by the projecting portion. Accordingly, in the soldering step, capillary action or the like facilitates the wetting of solder in the gap, and a solder layer is favorably formed in the gap. This makes it possible to obtain stable strength of the mechanical and electrical connection between the connected object and the mounting member.

In the connection structure using a terminal of the present invention, the body portion of the terminal was formed in the major arc cylindrical shape or the overlapping cylindrical shape having elasticity and was provided with the projecting portion projecting toward the outside. This made it possible to provide a connection structure using a terminal with which the terminal to which the connected object is connected can be fitted into the through hole provided in the mounting member with a predetermined fitting force so that the terminal with the connected object stands on its own relative to the mounting member and the gap between the terminal with the connected object and the wall constituting the through hole is ensured in the fitting step, capillary action or the like can facilitate the wetting of solder in the gap so that the solder layer is favorably formed in the gap in the soldering step, and stable strength of the mechanical and electrical connection between the connected object and the mounting member can be obtained.

EMBODIMENTS FOR CARRYING OUT THE INVENTION

Figure 1:
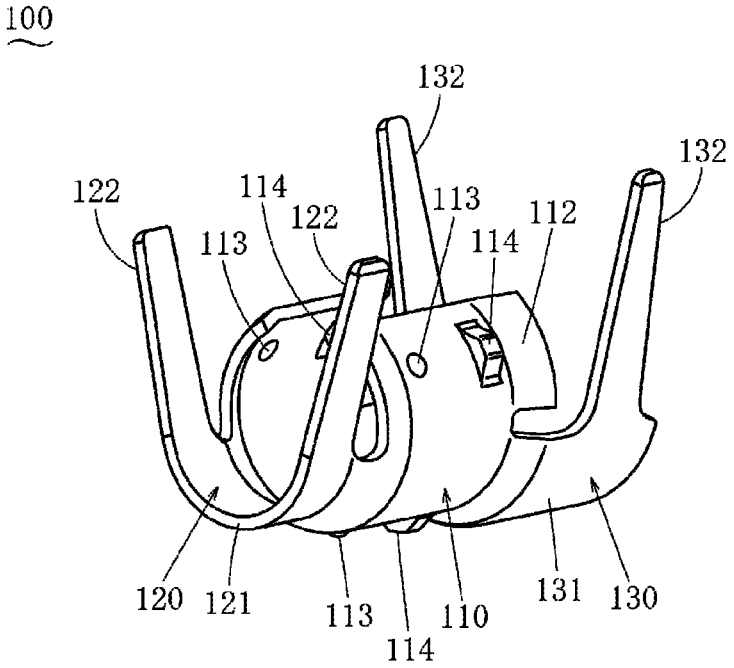
FIG. 1 is a perspective view of an embodiment of a terminal of the present invention.
Figure 2:
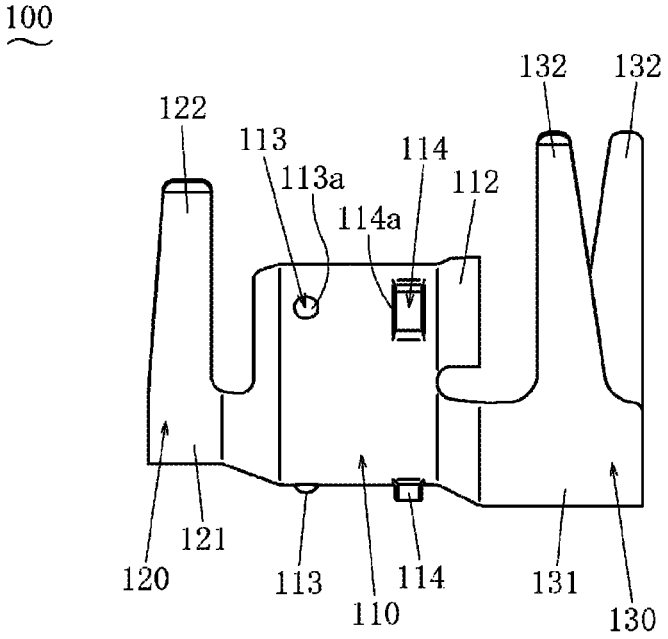
FIG. 2 is a side view of the terminal according to the embodiment.
Figure 3:
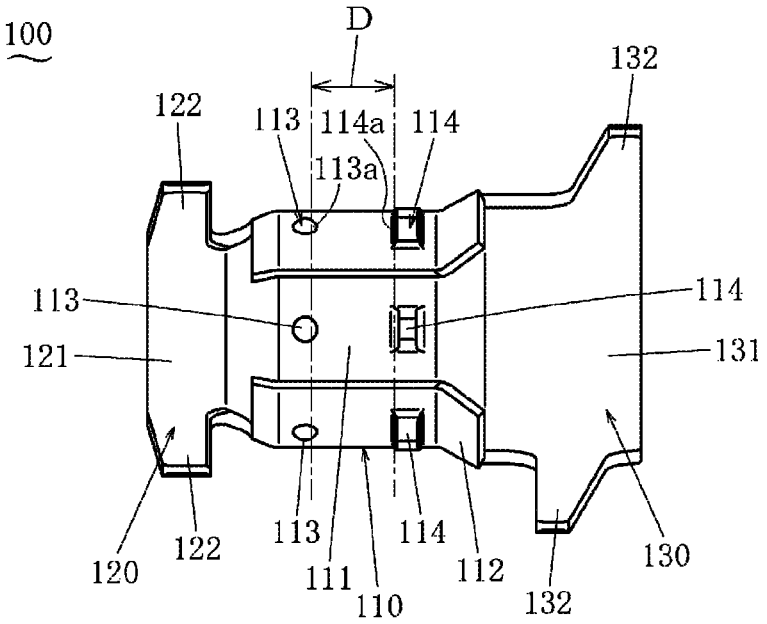
FIG. 3 is a plan view of the terminal.
Figure 4:
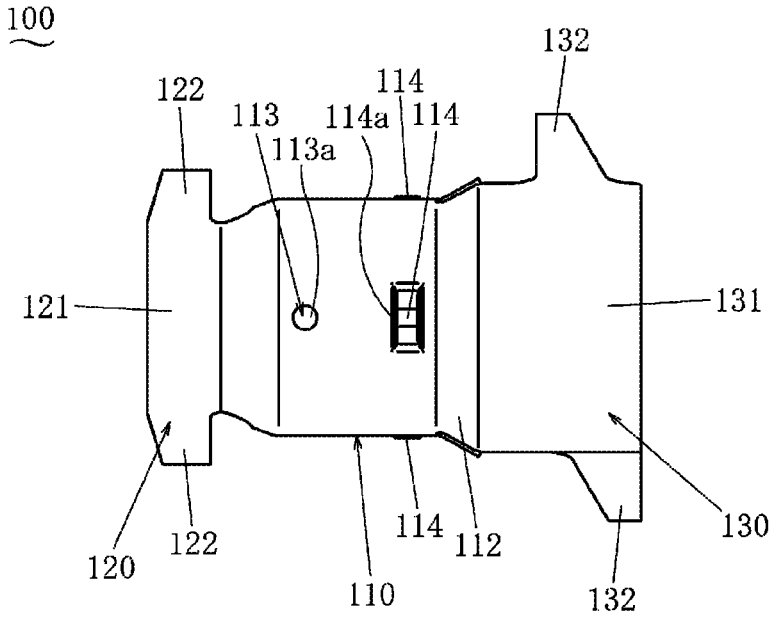
FIG. 4 is a bottom view of the terminal.

Hereinafter, an embodiment of the present invention will be described. FIGS. 1 to 14 show an embodiment of a terminal of the present invention. This terminal 100 is used to connect a connected object 200 having a rod-shaped conductor 210 to a mounting member 300 provided with a through hole 310. Specifically, the terminal 100 includes a body portion 110 and locking portions. The connected object 200 is mechanically and electrically connected to the mounting member 300 by connecting the conductor 210 of the connected object 200 to the terminal 100, inserting and fitting the body portion 110 of the terminal with the connected object into the through hole 310 of the mounting member 300, and soldering the body portion 110 and a conductive portion 320 of the mounting member 300 or soldering the conductor 210, the body portion 110 and the conductive portion 320 of the mounting member 300. Although, in this embodiment, the body portion 110 and the locking portions are molded in one piece using a plate-shaped conductive material having elasticity, the material of the body portion and the locking portions may be formed using a material having another form, such as a massive material, or the body portion and the locking portions may be separately formed using the same material or different materials and then be connected to each other, for example.

Figure 5:
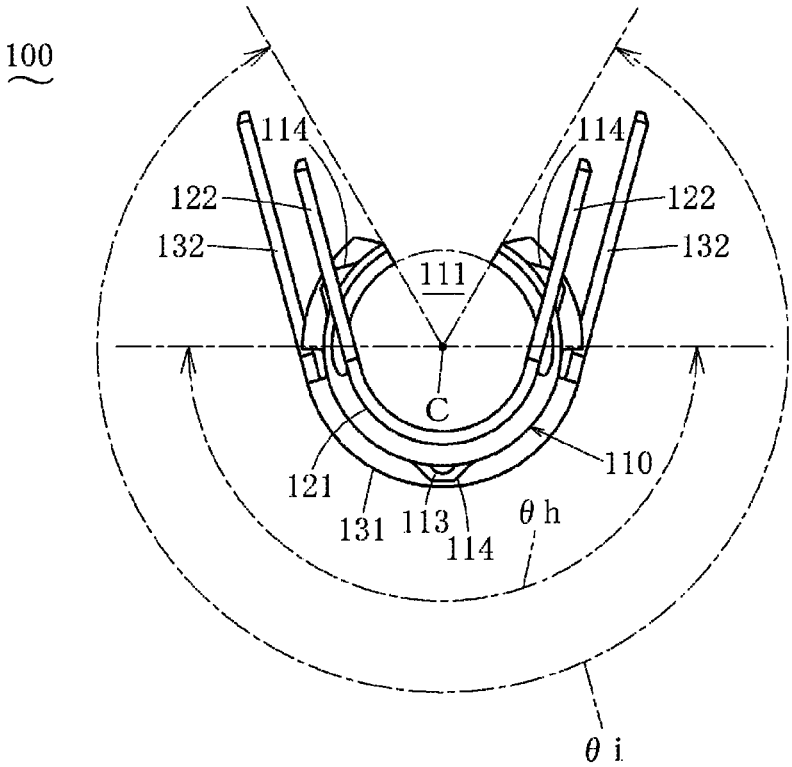
FIG. 5 is a front view of the terminal, as viewed from the back side in the insertion direction.
Figure 6:
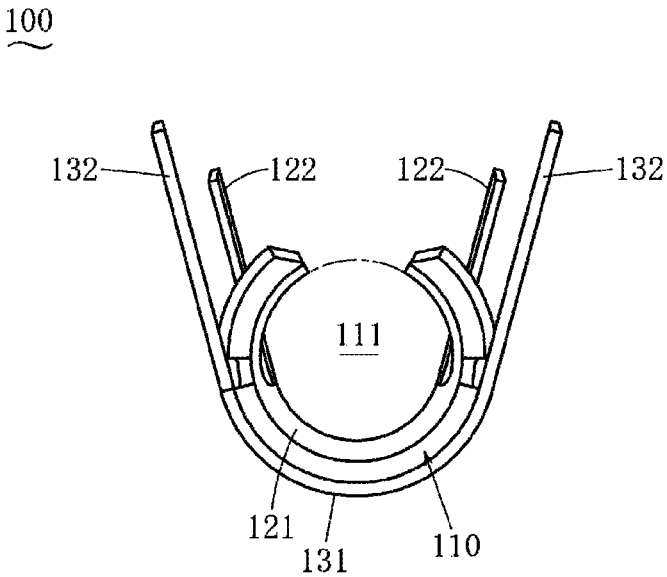
FIG. 6 is a back view of the terminal, as viewed from the front side in the insertion direction.
Figure 27:
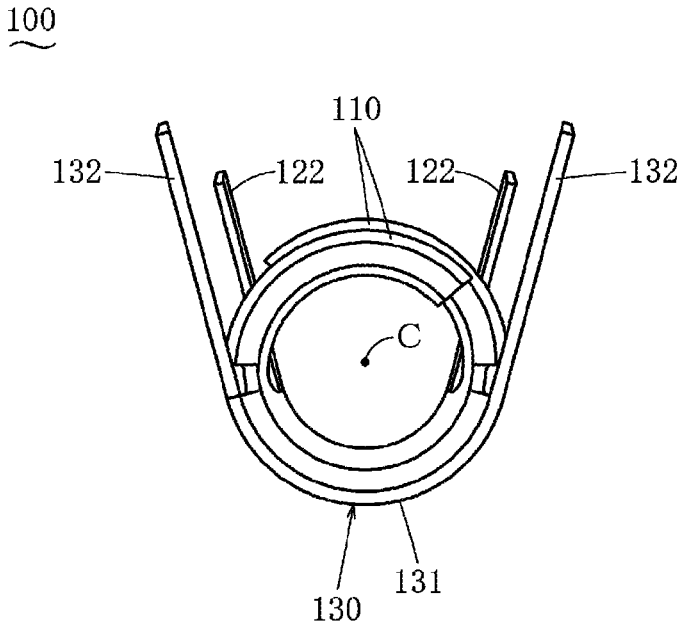
FIG. 27 is a back view of a terminal according to a variation having a body portion formed in an overlapping cylindrical shape, as viewed from the front side in the insertion direction.

The body portion 110 is made of a conductive material having elasticity. The body portion 110 is provided in a major arc cylindrical shape or an overlapping cylindrical shape, as viewed from an insertion direction, such that a cylindrical space 111 whose generating line extends in the insertion direction is formed inside the body portion 110. The insertion direction refers to a direction in which the body portion 110 of the terminal with the connected object is inserted into the through hole 310 of the mounting member 300, and is indicated by an arrow in FIG. 11. A semi-cylindrical shape is a shape of a half of a cylindrical object obtained by cutting the cylindrical object exactly in half with a plane including the central axis C, and the major arc cylindrical shape is a shape of a larger portion of two portions obtained by cutting a cylindrical object with a plane including an axis shifted from the central axis C in the radial direction. The body portion 110 of this embodiment is formed in the major arc cylindrical shape. The central axis C also serves as the central axis of a cylindrical space formed inside the cylindrical object. That is, as shown in FIG. 5, the major arc cylindrical shape is a shape in which a central angle $\theta i$ is greater than 180 degrees and a gap is formed between the two edges in a circumferential direction, as viewed from the insertion direction. In contrast, in the semi-cylindrical shape, as shown in FIG. 5, a central angle $\theta h$ is 180 degrees, as viewed from the insertion direction. The gap is formed in order to prevent the two edges in the circumferential direction from coming into contact with each other and interfering with each other when the body portion 110 is fitted into the through hole 310 and the body portion 110 is elastically deformed such that the length in the circumferential direction is reduced. The overlapping cylindrical shape is not a cylindrical shape that is continuous in the circumferential direction, but rather a cylindrical shape in which the two edges in the circumferential direction overlap each other. As an example, FIG. 27 shows a terminal 100 according to a variation related to the body portion. The two edges in the circumferential direction overlap each other so that the two edges are relatively displaced in the circumferential direction and the overlapping length easily changes when the body portion 110 is fitted into the through hole 310 and the body portion 110 is elastically deformed such that the length in the circumferential direction is reduced. A flare portion 112 is formed on the front side in the insertion direction of the body portion. This flare portion 112 is formed in a funnel shape such that the diameter increases toward the front side in the insertion direction. The present invention encompasses an embodiment in which the body portion is not provided with the flare portion.

Figure 10:
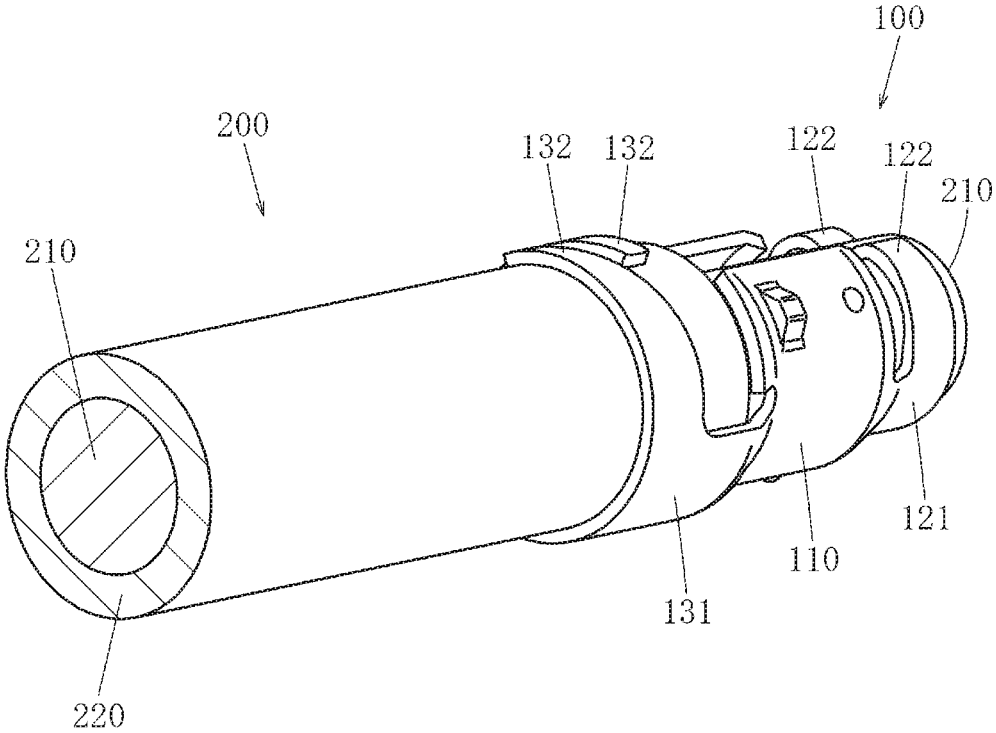
FIG. 10 is a perspective view illustrating a state in which the locking portions of the terminal have been crimped to the connected object.
Figure 11:
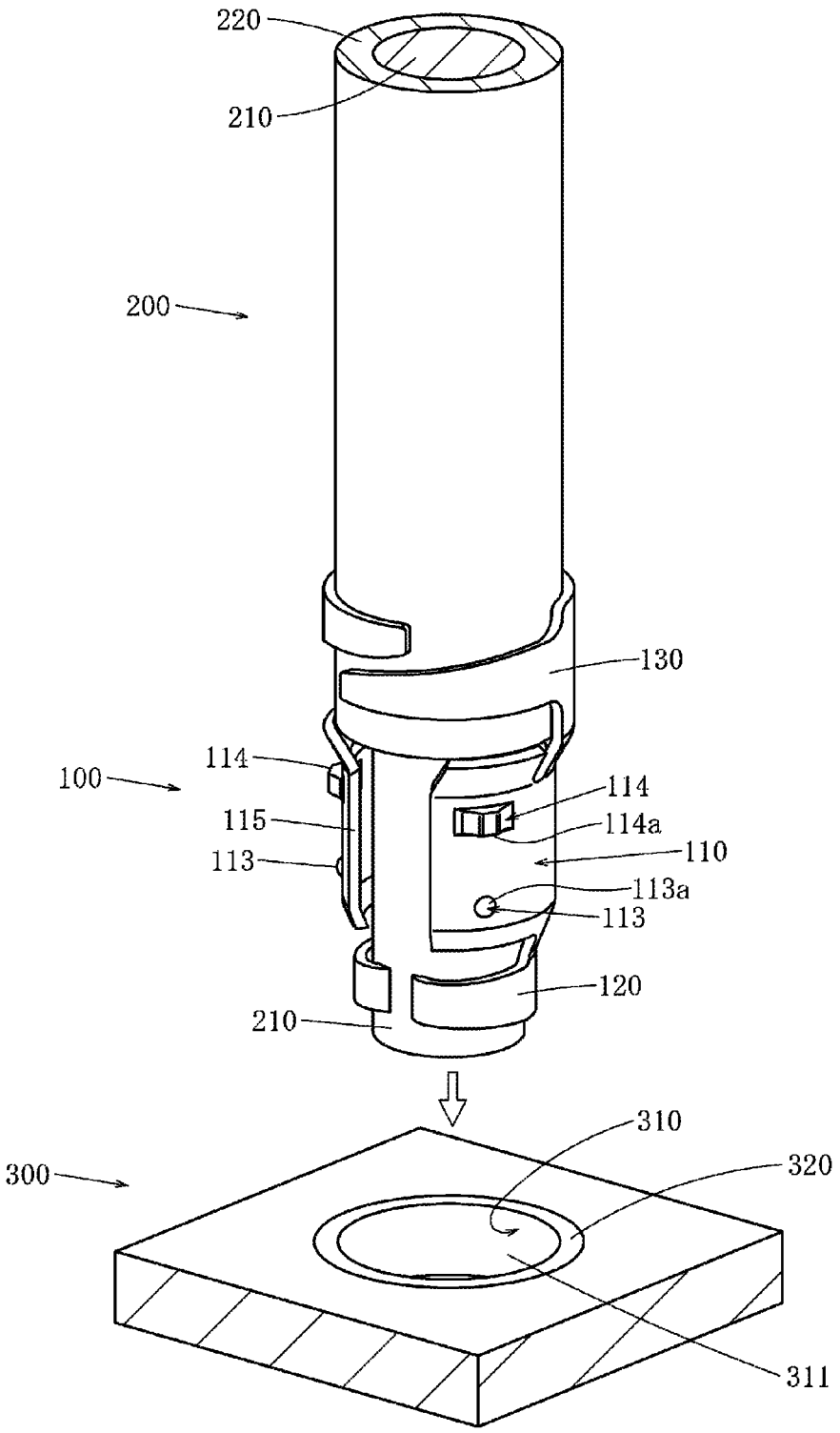
FIG. 11 is a perspective view illustrating a state in which the terminal with the connected object is being inserted into the through hole of the mounting member.
Figure 12:
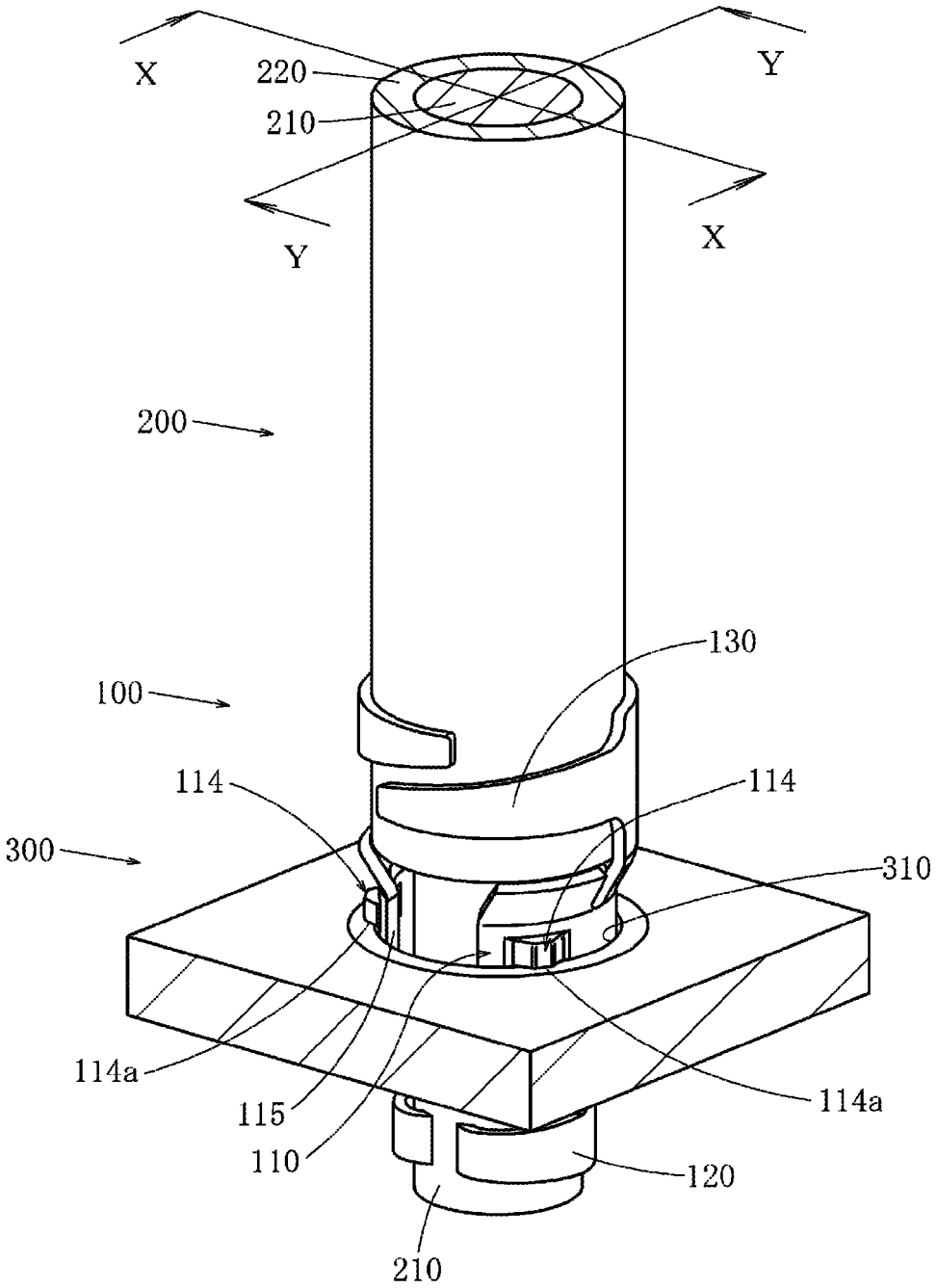
FIG. 12 is a perspective view illustrating a state in which the terminal with the connected object has been pushed in the insertion direction from the state shown in FIG. 11 and has been inserted into the through hole of the mounting member.
Figure 13:
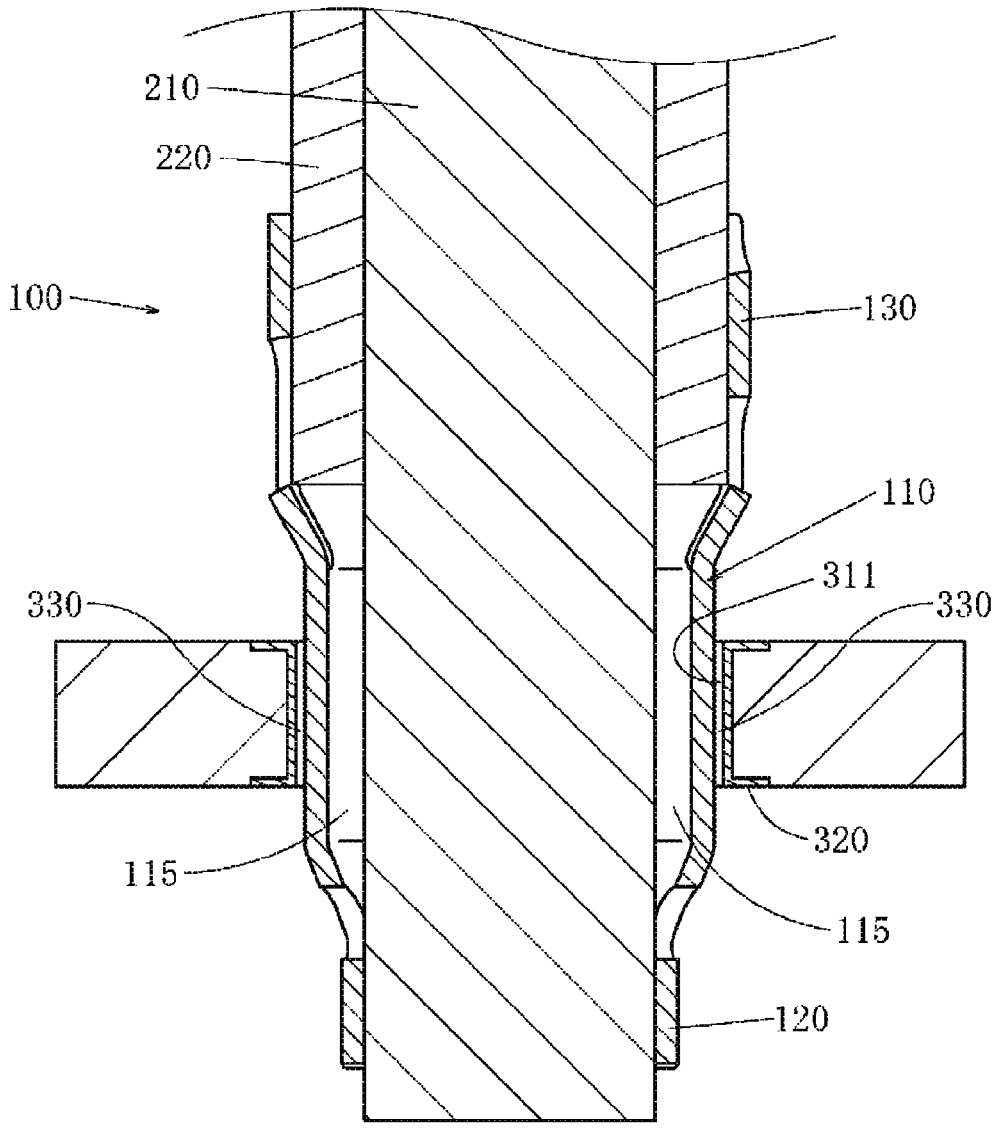
FIG. 13 is an enlarged cross-sectional view taken along line X-X in FIG. 12.
Figure 14:
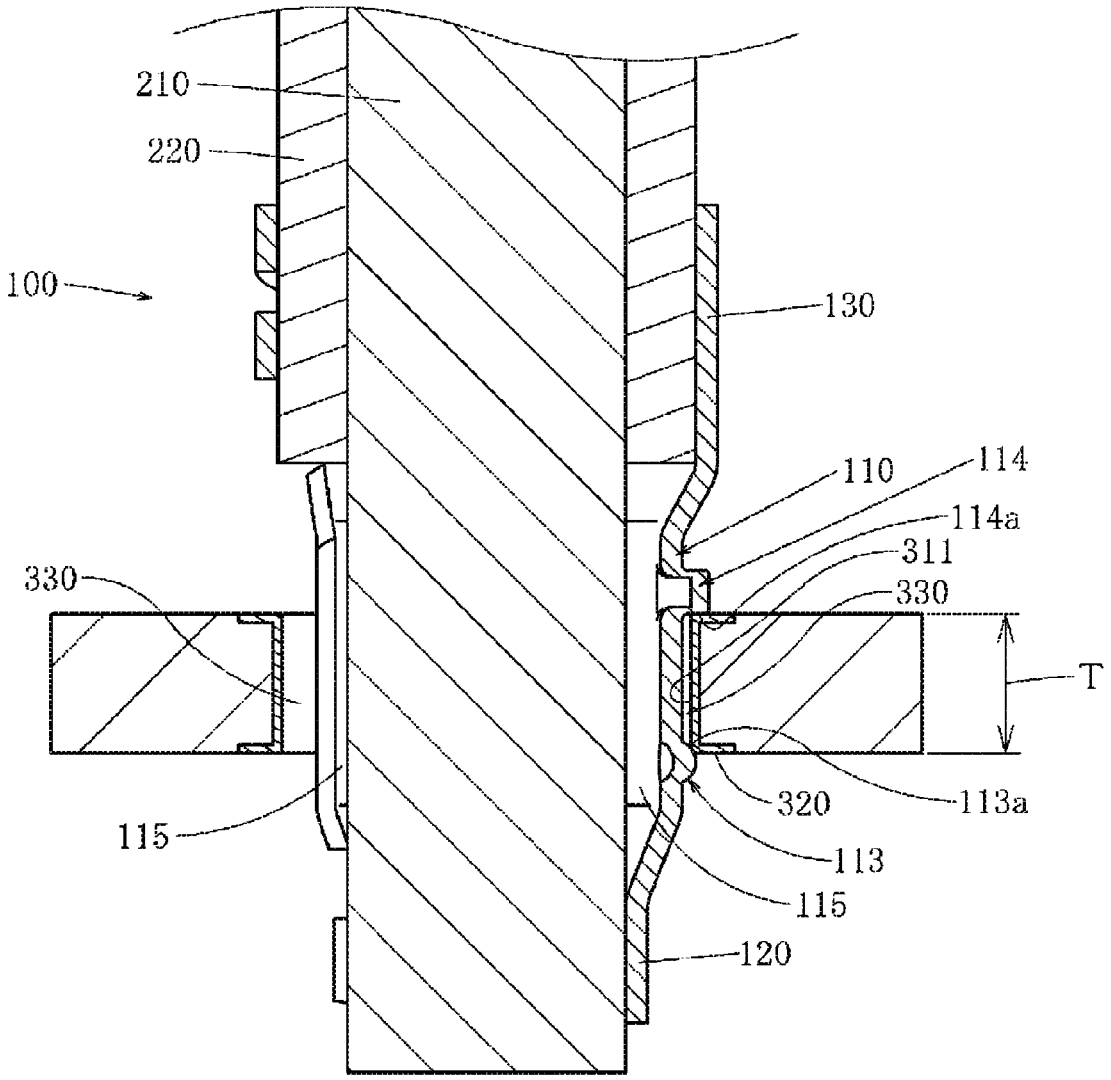
FIG. 14 is an enlarged cross-sectional view taken along line Y-Y in FIG. 12.
Figure 15:
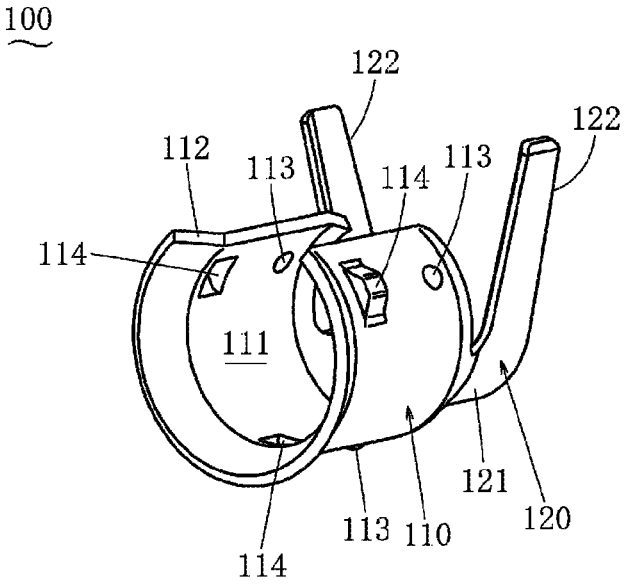
FIG. 15 is a perspective view of a terminal according to a first variation related to the locking portions.
Figure 16:
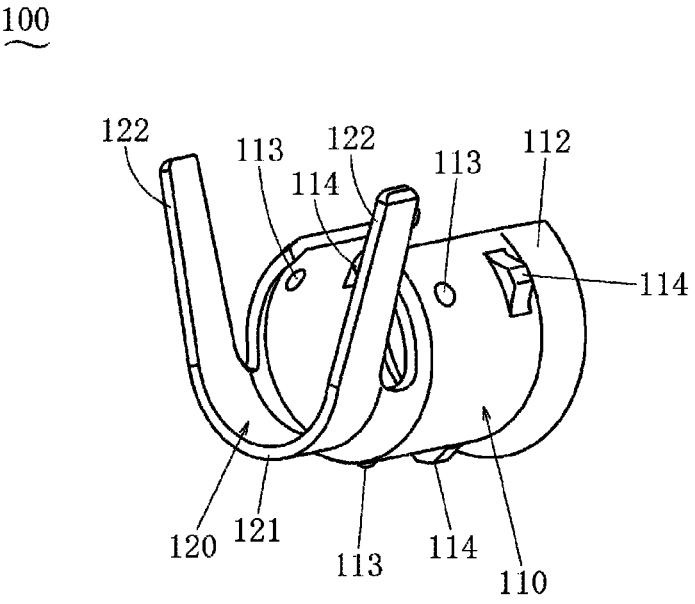
FIG. 16 is a perspective view of the terminal according to the first variation related to the locking portions, as viewed from another side.
Figure 17:
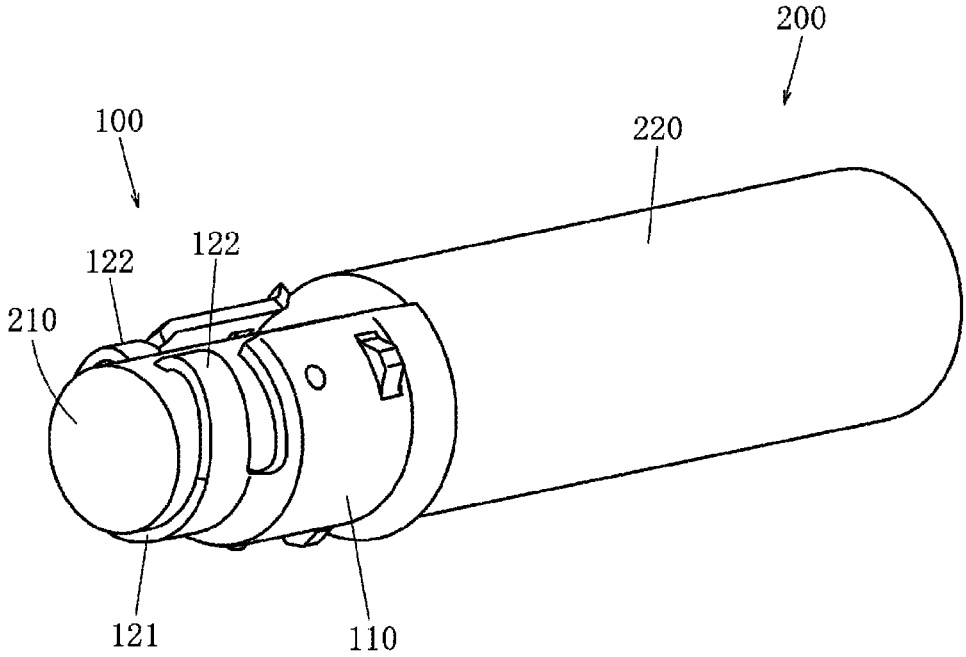
FIG. 17 is a perspective view illustrating a state in which the locking portion of the terminal according to the first variation related to the locking portions has been crimped to the connected object.
Figure 18:
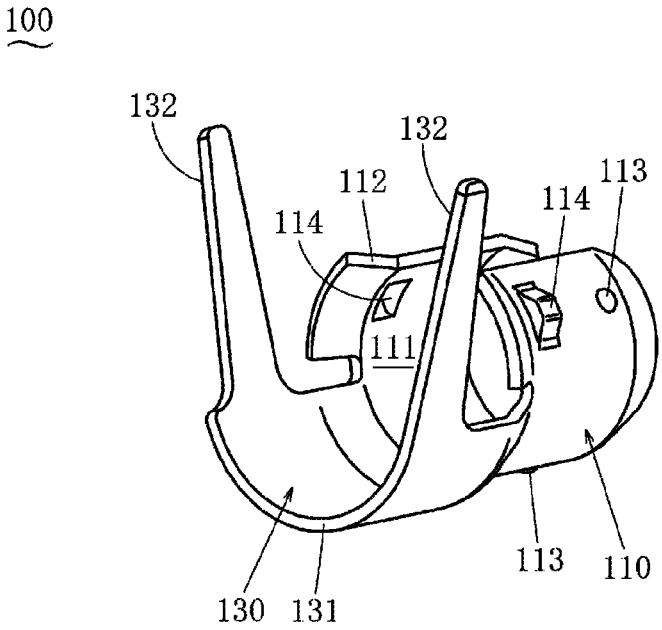
FIG. 18 is a perspective view of a terminal according to a second variation related to the locking portions.
Figure 19:
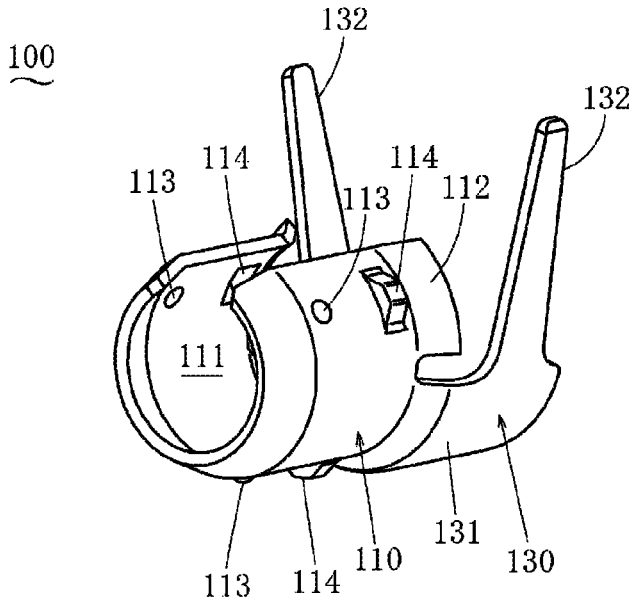
FIG. 19 is a perspective view of the terminal according to the second variation related to the locking portions, as viewed from another side.
Figure 20:
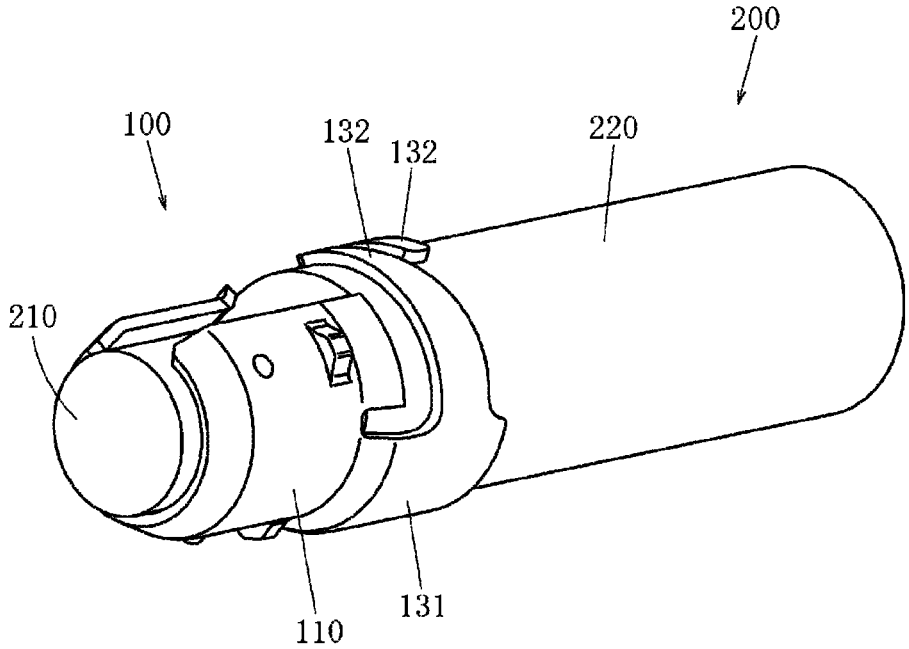
FIG. 20 is a perspective view illustrating a state in which the locking portion of the terminal according to the second variation related to the locking portions has been crimped to the connected object.
Figure 28:
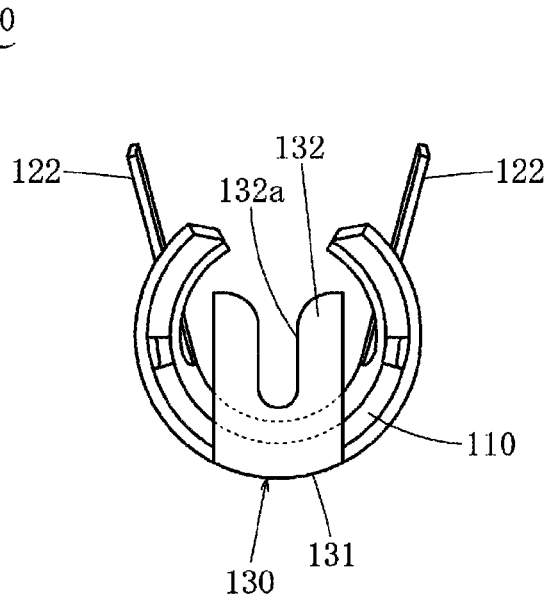
FIG. 28 is a back view of a terminal according to a third variation related to the locking portions, as viewed from the front side in the insertion direction.
Figure 29:
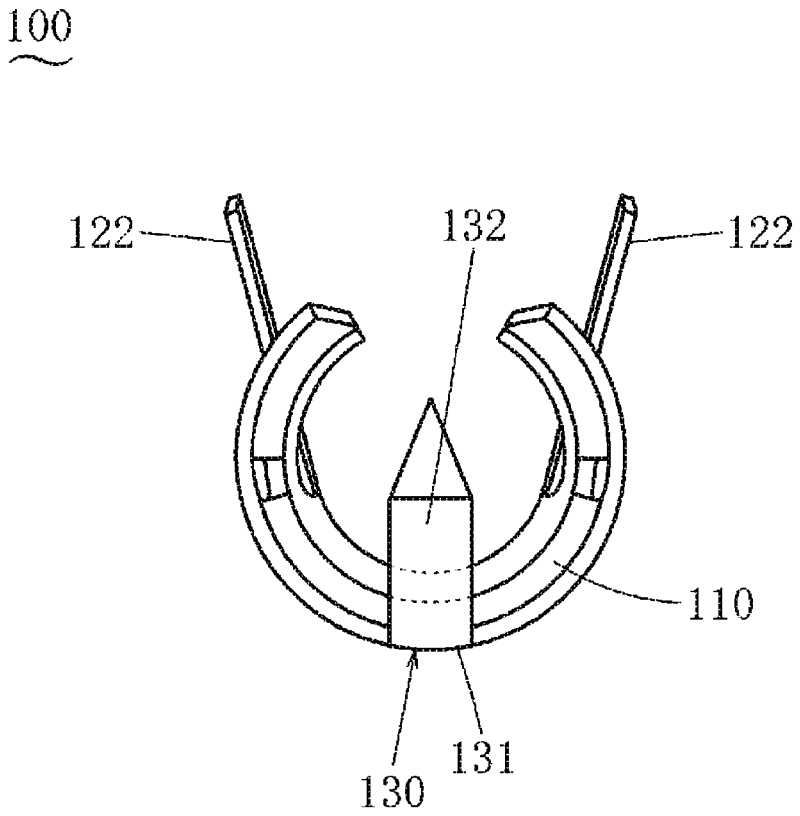
FIG. 29 is a back view of a terminal according to a fourth variation related to the locking portions, as viewed from the front side in the insertion direction.
Figure 30:
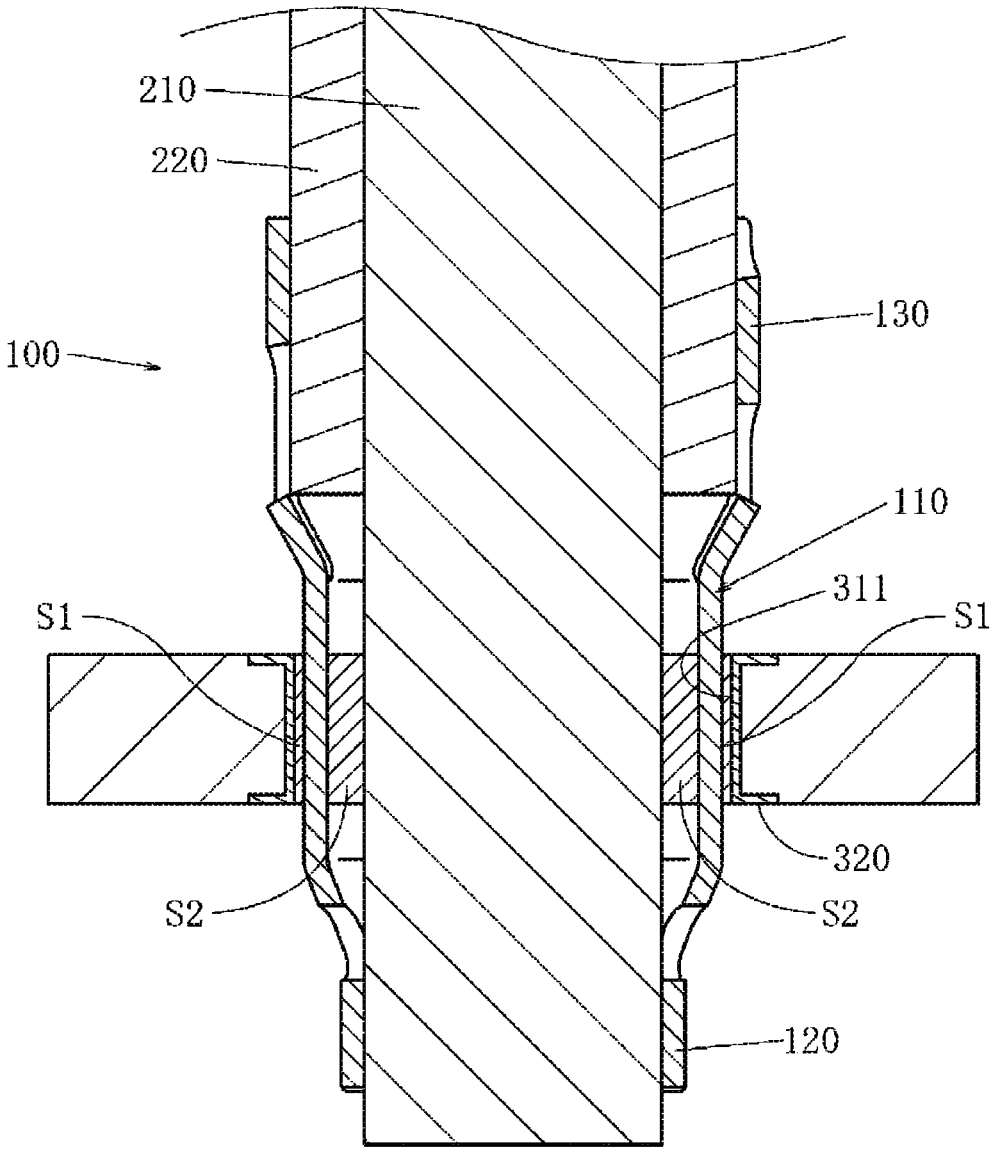
FIG. 30 is a diagram corresponding to FIG. 13, showing a connection structure obtained using the terminal.
Figure 31:
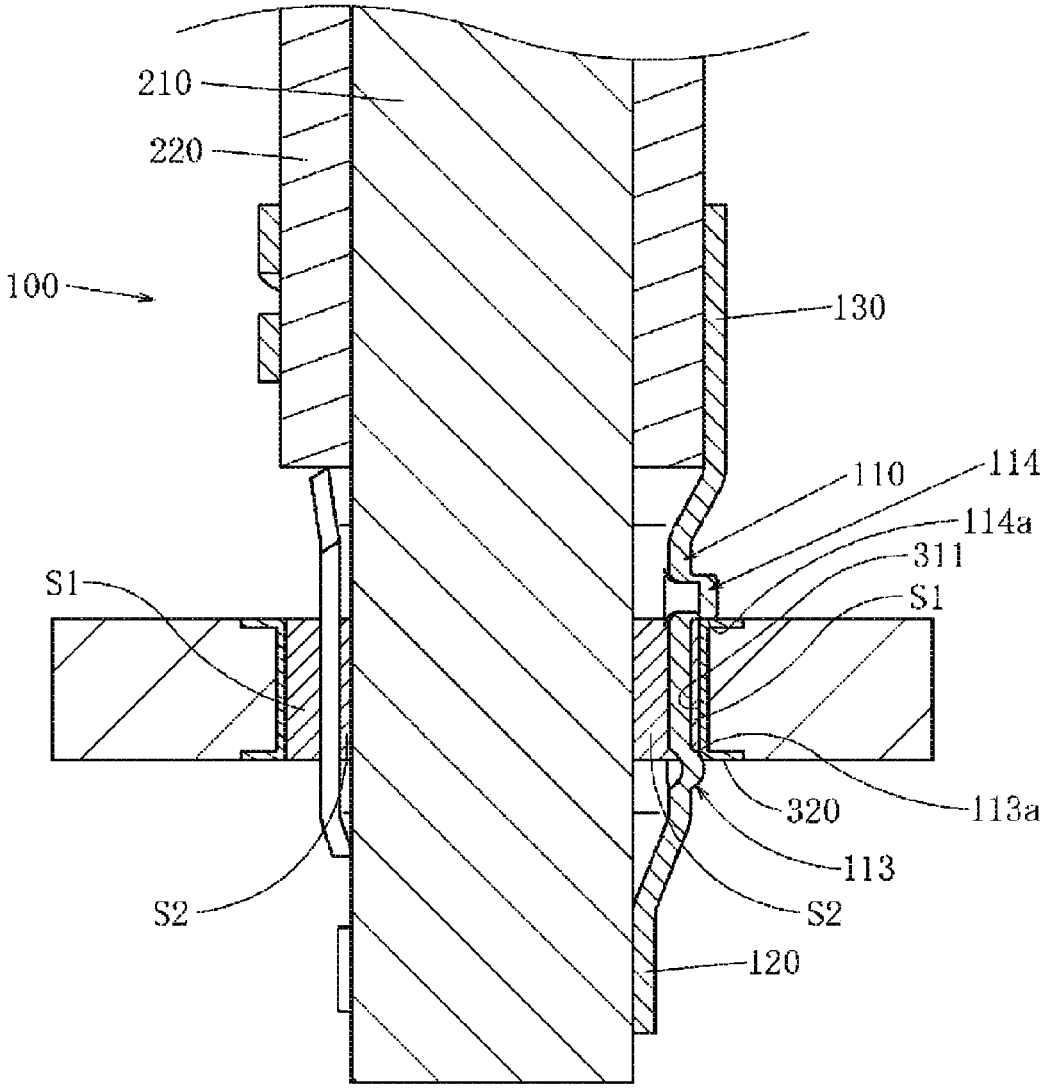
FIG. 31 is a diagram corresponding to FIG. 14, showing the connection structure obtained using the terminal.

The locking portion is disposed on at least one side out of the back side and the front side in the insertion direction of the body portion. The locking portion has a base piece extending from the body portion toward the back side in the insertion direction or the front side in the insertion direction, and locking pieces provided on the base piece. The locking portion can be made of any material. In this embodiment, the locking portion is disposed on both the back side in the insertion direction and the front side in the insertion direction of the body portion. That is, a first locking portion 120 is disposed on the back side in the insertion direction of the body portion 110, and a second locking portion 130 is disposed on the front side in the insertion direction of the body portion 110. The first locking portion 120 has a base piece 121 extending from the body portion 110 toward the back side in the insertion direction, and locking pieces 122 provided on the base piece 121. The second locking portion 130 has a base piece 131 extending from the body portion 110 toward the front side in the insertion direction, and locking pieces 132 provided on the base piece 131. The first locking portion 120 is a crimping type. Accordingly, the locking piece 122 is a barrel that rises in the thickness direction from at least one side out of the two sides in the width direction of the base piece 121. Here, although the locking pieces 122 rise in the thickness direction from the two sides in the width direction, the locking piece may rise from only one side in the width direction. The width direction refers to a direction orthogonal to the insertion direction, and the thickness direction refers to a direction orthogonal to both the insertion direction and the width direction. The second locking portion 130 is the crimping type. Accordingly, the locking piece 132 is a barrel that rises in the thickness direction from at least one side out of the two sides in the width direction of the base piece 131. Here, although the locking pieces 132 rise in the thickness direction from the two sides in the width direction, the locking piece may rise from only one side in the width direction. The two locking pieces 132 of the second locking portion 130 are shifted with respect to each other in the insertion direction. This is preferable because there is an advantage that, for example, when a plurality of second locking portions 130 are manufactured by punching out the second locking portions 130 from a continuous plate-shaped material, the material can be effectively used by performing a blank layout such that one second locking portion 130 is shifted in the insertion direction from the second locking portion 130 of an adjacent terminal. However, the two locking pieces of the second locking portion may be provided so as to overlap each other, as viewed from the width direction, similarly to the two locking pieces 122 of the first locking portion 120. The two locking pieces of the first locking portion may also be shifted with respect to each other in the insertion direction similarly to the two locking pieces 132 of the second locking portion 130. As shown in FIG. 10, the locking pieces 122 of the first locking portion 120 and the locking pieces 132 of the second locking portion 130 are configured to cling to the connected object 200 with a pressing force by being bent toward the inside and to be crimped to the connected object 200. As an example, FIGS. 15 to 17 show a terminal 100 according to a first variation related to the locking portions. In this terminal 100 according to the first variation, a first locking portion 120 is provided on the back side in the insertion direction of the body portion 110, but no second locking portion 130 is provided on the front side in the insertion direction of the body portion 110. The locking pieces 122 of the first locking portion 120 are configured to cling to the connected object 200 with a pressing force by being bent toward the inside and to be crimped to the connected object 200. FIGS. 18 to 20 show a terminal 100 according to a second variation related to the locking portions. In this terminal 100 according to the second variation, no first locking portion 120 is provided on the back side in the insertion direction of the body portion 110, but a second locking portion 130 is provided on the front side in the insertion direction of the body portion 110. The locking pieces 132 of the second locking portion 130 are configured to cling to the connected object 200 with a pressing force by being bent toward the inside and to be crimped to the connected object 200. FIG. 28 shows a terminal 100 according to a third variation related to the locking portions. In this terminal 100 according to the third variation, the first locking portion 120 is the crimping type, but the second locking portion 130 is not the crimping type, but rather an insulation-displacement type. Accordingly, the locking piece 132 of the second locking portion 130 is a plate piece that faces the insertion direction and rises from the base piece 131 in the thickness direction, a recessed portion that extends in the thickness direction from the tip end of the plate piece toward its base is formed, and an insulation-displacement blade 132*a* is formed at the edge of the recessed portion. A configuration is adopted in which, when the connected object 200 is pushed in the thickness direction into the locking piece 132, the insulation-displacement blade 132*a* cuts into the outer circumferential portion of the connected object 200, and thus the connected object 200 is locked to the second locking portion 130. The first locking portion may be the insulation-displacement type while the second locking portion may be the crimping type. Both the first locking portion and the second locking portion may also be the insulation-displacement type. FIG. 29 shows a terminal 100 according to a fourth variation related to the locking portions. In this terminal 100 according to the fourth variation, the first locking portion 120 is the crimping type, but the second locking portion 130 is not the crimping type, but rather a piercing type. Accordingly, the locking piece 132 of the second locking portion 130 is a plate piece that faces the width direction and rises from the base piece 131 in the thickness direction, and the tip end of the plate piece is sharp. A configuration is adopted in which, when the connected object 200 is pushed in the thickness direction into the locking piece 132, the locking piece 132 pierces the connected object 200, and thus the connected object 200 is locked to the second locking portion 130. The first locking portion may be the piercing type while the second locking portion may be the crimping type. Both the first locking portion and the second locking portion may also be the piercing type. Also, the first locking portion may be any of the crimping type, the insulation-displacement type, the piercing type and another locking structure while the second locking portion may be any of the crimping type, the insulation-displacement type, the piercing type and another locking structure. They can be freely combined.

The body portion 110 has at least one projecting portion that projects toward the outside. The outside refers to a side apart from the cylindrical space 111, and its opposite side is the inside. The projecting portion may have a spherical shape including a semi-spherical shape, a rectangular parallelepiped shape, a circular cone shape, a truncated cone shape, a pyramid shape, a truncated pyramid shape, or another shape, for example. The projecting portion may be formed by pressing a portion of the body portion from the inside of the body portion to its outside, for example, or the projecting portion that has been formed separately from the body portion may be attached to the outer surface of the body portion by brazing, gluing, or another method, for example. Although the projecting portion has elasticity in this embodiment, the projecting portion may have no elasticity. Moreover, although a wall 311 constituting the through hole 310 has elasticity in this embodiment, the wall may have no elasticity. A configuration is adopted in which, when the body portion 110 is fitted into the through hole 310 of the mounting member 300, the body portion 110 is elastically deformed, and thus the projecting portion comes into contact with the wall 311 constituting the through hole 310 with a pressing force. In this case, the projecting portion may be elastically deformed or the wall constituting the through hole may be elastically deformed. In this case, an embodiment of the projecting portion is the projecting portion such as a first projecting portion 113 described later that, when the body portion 110 is fitted into the through hole 310, passes through the through hole 310 due to the elastic deformation of the body portion 110 so that a portion there of projects from the back side in the insertion direction of the through hole 310, and that comes into contact with and remains at an edge of an opening of the through hole 310 on the back side in the insertion direction, that is, the end portion on the back side in the insertion direction of the wall 311 constituting the through hole 310, with a pressing force applied in the radial direction of the major arc cylindrical shape or the overlapping cylindrical shape. Also, an embodiment of the projecting portion is the projecting portion such as a second projecting portion 114 described later that, when the body portion 110 is fitted into the through hole 310, partially remains on the front side in the insertion direction of the through hole 310 due to the elastic deformation of the body portion 110, and that comes into contact with and remains at an edge of an opening of the through hole 310 on the front side in the insertion direction, that is, the end portion on the front side in the insertion direction of the wall 311 constituting the through hole 310, with a pressing force applied in the radial direction of the major arc cylindrical shape or the overlapping cylindrical shape. Furthermore, an embodiment of the projecting portion is the projecting portion that, when the body portion 110 is fitted into the through hole 310, enters the through hole 310 due to the elastic deformation of the body portion 110, and that comes into contact with and remains at an intermediate portion in the insertion direction of the wall 311 with a pressing force applied in the radial direction of the major arc cylindrical shape or the overlapping cylindrical shape (see FIG. 32, for example). Here, it has been stated that the projecting portion comes into contact with the wall constituting the through hole with a pressing force due to the elastic deformation of the body portion 110, but if the projecting portion has elasticity, the projecting portion comes into contact with the end portion on the back side in the insertion direction, the end portion on the front side in the insertion direction or the intermediate portion in the insertion direction of the wall with a pressing force also due to the elastic deformation of the projecting portion, and if the wall has elasticity, the projecting portion comes into contact with the end portion on the back side in the insertion direction, the end portion on the front side in the insertion direction or the intermediate portion in the insertion direction of the wall with a pressing force also due to the elastic deformation of the wall. A configuration is adopted in which an envelope curve connecting the outer end portions of the projecting portions or an envelope curve connecting the outer end portions of the projecting portions and the outer circumferential surface of the body portion 110 is slightly larger than the through hole 310 of the mounting member 300, as viewed from the insertion direction.

In this embodiment, the first projecting portions 113 are provided on the back side in the insertion direction of the body portion 110, and the second projecting portions 114 are provided on the front side in the insertion direction thereof. Three first projecting portions 113 are provided with intervals in the circumferential direction of the body portion 110, and three second projecting portions 114 are provided with intervals in the circumferential direction of the body portion 110. However, the number and the arrangement of the projecting portions are not intended to be limited by this. It is sufficient to provide at least one projecting portion. When two or more projecting portions are provided, their relative positions on the body portion in the insertion direction and the circumferential direction may be arbitrarily determined.

Figure 7:
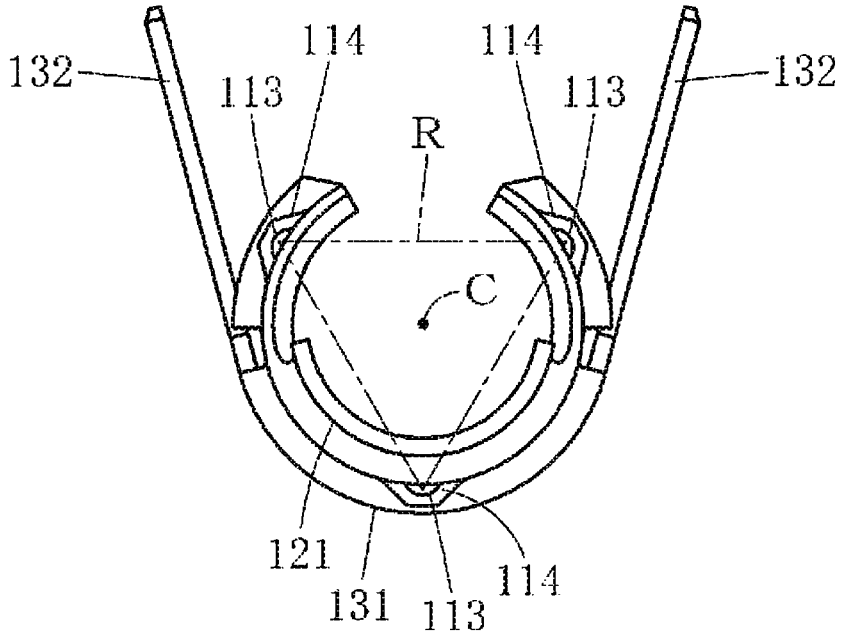
FIG. 7 shows a state in which an end portion of a first locking portion has been removed from the terminal shown in FIG. 5.
Figure 8:
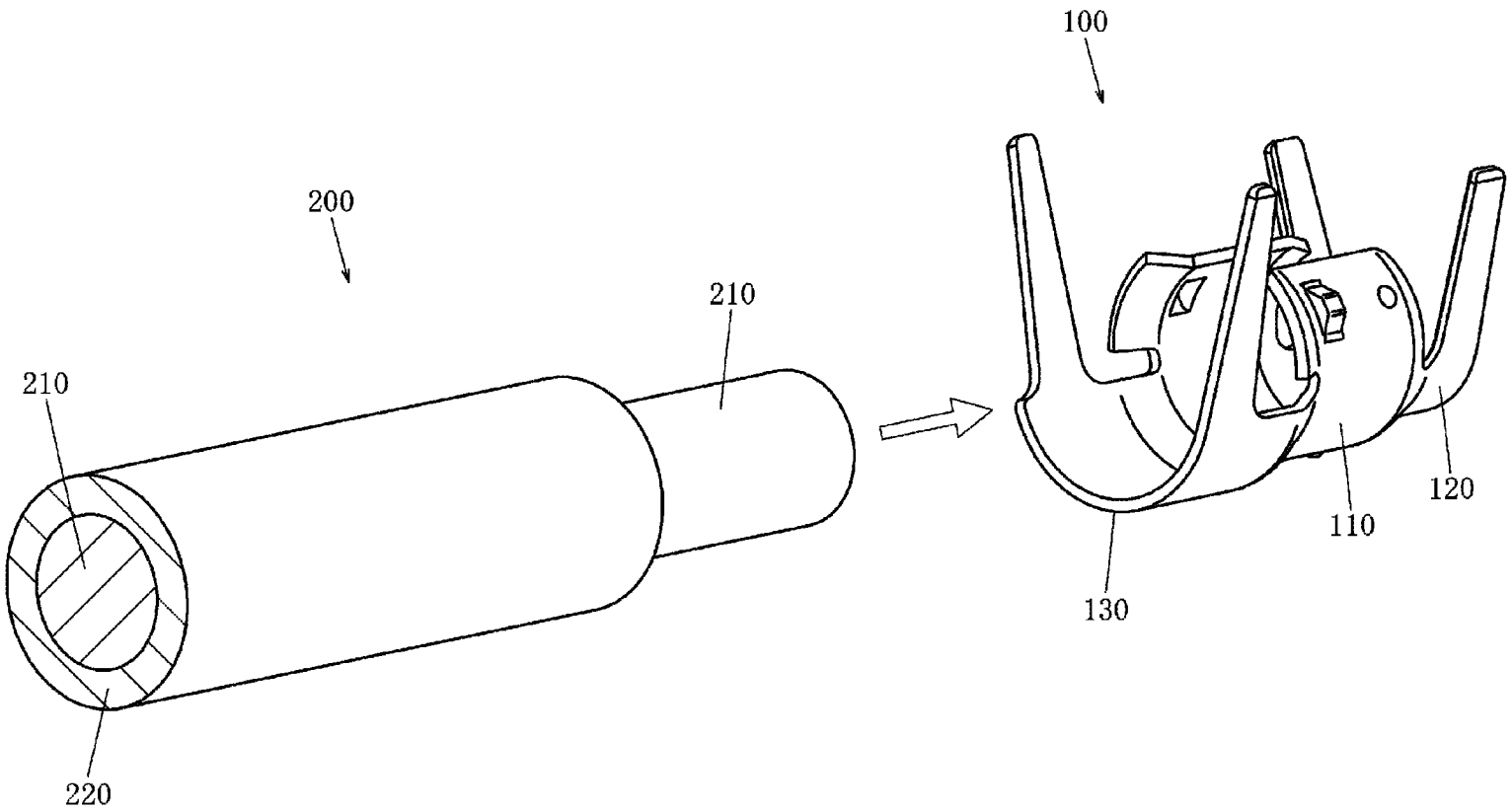
FIG. 8 is a perspective view illustrating a state in which the conductor is being inserted into the body portion of the terminal.
Figure 9:
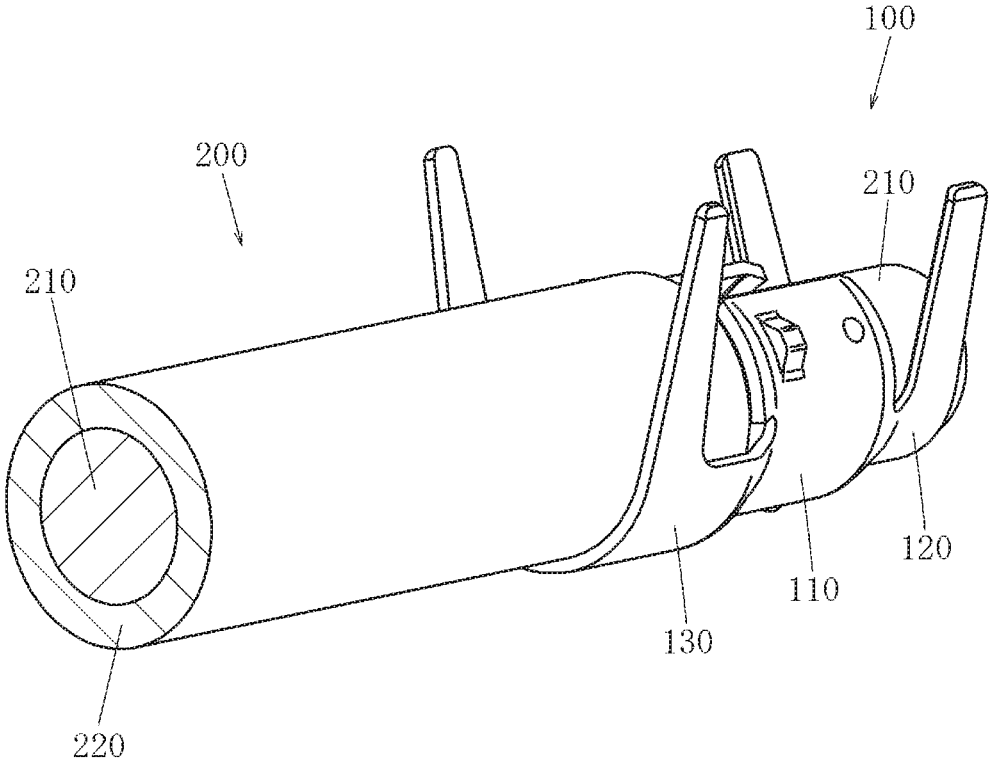
FIG. 9 is a perspective view illustrating a state in which the conductor has been inserted into the body portion of the terminal.

Three or more projecting portions are provided, and three of these projecting portions are provided at three positions that, if connected, form a triangle inside which the central axis of the major arc cylindrical shape or the overlapping cylindrical shape is located, as viewed from the insertion direction. The projecting portions may be provided at positions other than these three positions. In this embodiment, the first projecting portions 113 are provided on the back side in the insertion direction of the body portion 110 and the second projecting portions 114 are provided on the front side in the insertion direction thereof. As shown in FIG. 7, the first projecting portions 113 are provided at three positions that, if connected, form a triangle R inside which the central axis C of the major arc cylindrical shape or the overlapping cylindrical shape is located, as viewed from the insertion direction, and the second projecting portions 114 are provided at three positions that, if connected, form a triangle R inside which the central axis C of the major arc cylindrical shape or the overlapping cylindrical shape is located, as viewed from the insertion direction. Either the first projecting portions 113 or the second projecting portions 114 may be provided at these three positions or three of the first projecting portions 113 and the second projecting portions 114 may be provided so as to be located at these three positions.

A surface 113*a* of the first projecting portion 113 on the front side in the insertion direction is formed to be inclined toward the back side in the insertion direction as the surface 113*a* extends toward the outside, and a surface 114*a* of the second projecting portion 114 on the back side in the insertion direction is formed to be inclined toward the front side in the insertion direction as the surface 114*a* extends toward the outside. The distance in the insertion direction between an intermediate portion in the projecting direction of the first projecting portion 113 on the surface 113*a* of the first projecting portion 113 on the front side in the insertion direction and an intermediate portion in the projecting direction of the second projecting portion 114 on the surface 114*a* of the second projecting portion 114 on the back side in the insertion direction is equal to the thickness of the mounting member 300. That is, the first projecting portion 113 is formed in a semi-spherical shape whose center is located on the surface of the body portion 110, and therefore, the surface 113*a* of the first projecting portion 113 on the front side in the insertion direction is formed to be inclined toward the back side in the insertion direction as the surface 113*a* extends toward the outside. The second projecting portion 114 is formed in a truncated quadrangular pyramid shape whose bottom surface is located on the surface of the body portion 110, and therefore, the surface 114*a* of the second projecting portion 114 on the back side in the insertion direction is formed to be inclined toward the front side in the insertion direction as the surface 114*a* extends toward the outside. A distance D (see FIG. 3) in the insertion direction between an intermediate portion in the projecting direction of the first projecting portion 113 on the surface 113*a* of the first projecting portion 113 on the front side in the insertion direction and an intermediate portion in the projecting direction of the second projecting portion 114 on the surface 114*a* of the second projecting portion 114 on the back side in the insertion direction is equal to a thickness T of the mounting member 300 (see FIG. 14). In this case, the first projecting portion may have not a semi-spherical shape, but rather another shape, and the first projecting portion need only be formed such that the surface of the first projecting portion on the front side in the insertion direction is formed to be inclined toward the back side in the insertion direction as the surface extends toward the outside. The second projecting portion may have not a truncated quadrangular pyramid shape, but rather another shape, and the second projecting portion need only be formed such that the surface of the second projecting portion on the back side in the insertion direction is formed to be inclined toward the front side in the insertion direction as the surface extends toward the outside.

Figure 21:
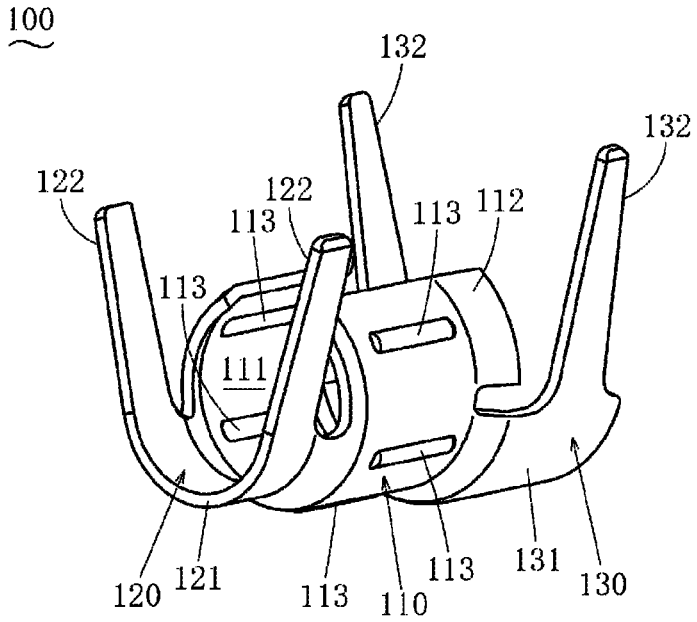
FIG. 21 is a perspective view of a terminal according to a first variation related to the projecting portions.
Figure 23:
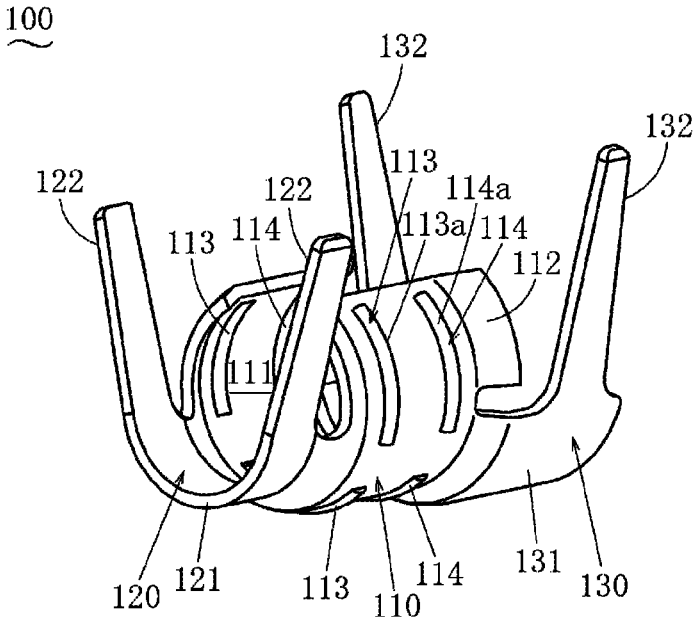
FIG. 23 is a perspective view of a terminal according to a second variation related to the projecting portions.
Figure 25:
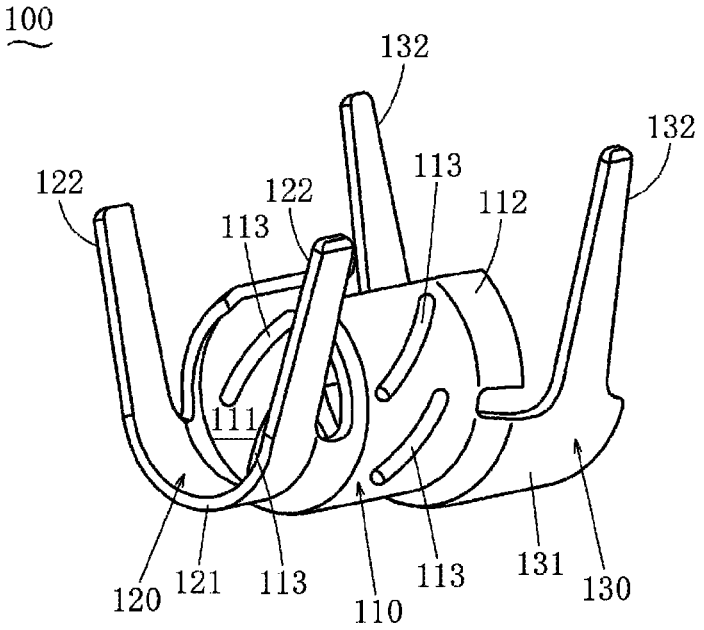
FIG. 25 is a perspective view of a terminal according to a third variation related to the projecting portions.

The projecting portions may be provided as dots on the body portion 110 similarly to the first projecting portions 113 or the second projecting portions 114, for example. However, as in the terminal 100 according to the first variation related to the projecting portions shown in FIG. 21, the projecting portion 113 may project from the body portion 110 toward the outside and extend linearly in the insertion direction, for example. Also, as in the terminal 100 according to the second variation related to the projecting portions shown in FIG. 23, the projecting portions 113 and 114 may project from the body portion 110 toward the outside and extend linearly in the circumferential direction of the body portion 110, for example. Here, as in the embodiment, the first projecting portions 113 are provided on the back side in the insertion direction of the body portion 110, and the second projecting portions 114 are provided on the front side in the insertion direction thereof. Therefore, the surface 113*a* of the first projecting portion 113 on the front side in the insertion direction may be formed to be inclined toward the back side in the insertion direction as the surface 113*a* extends toward the outside, the surface 114*a* of the second projecting portion 114 on the back side in the insertion direction may be formed to be inclined toward the front side in the insertion direction as the surface 114*a* extends toward the outside, and the distance in the insertion direction between an intermediate portion in the projecting direction of the first projecting portion 113 on the surface 113*a* of the first projecting portion 113 on the front side in the insertion direction and an intermediate portion in the projecting direction of the second projecting portion 114 on the surface 114*a* of the second projecting portion 114 on the back side in the insertion direction may be equal to the thickness of the mounting member 300. Furthermore, as in the terminal 100 according to the third variation related to the projecting portions shown in FIG. 25, the projecting portions 113 may project from the body portion 110 toward the outside and extend linearly in a direction oblique with respect to the insertion direction and the circumferential direction so as to be inclined toward the circumferential direction of the body portion 110 as the projecting portions 113 extend in the insertion direction, for example. A projecting stopper that projects toward the outside may be provided on the body portion, and may be configured such that when the body portion is fitted into the through hole, the entire stopper remains on the front side in the insertion direction of the through hole 310 and the stopper comes into contact with a circumferential edge portion of an opening of the through hole 310 on the front side in the insertion direction, that is, a circumferential edge portion of the end portion on the front side in the insertion direction of the wall 311 constituting the through hole 310, with a pressing force applied in the insertion direction.

Figure 22:
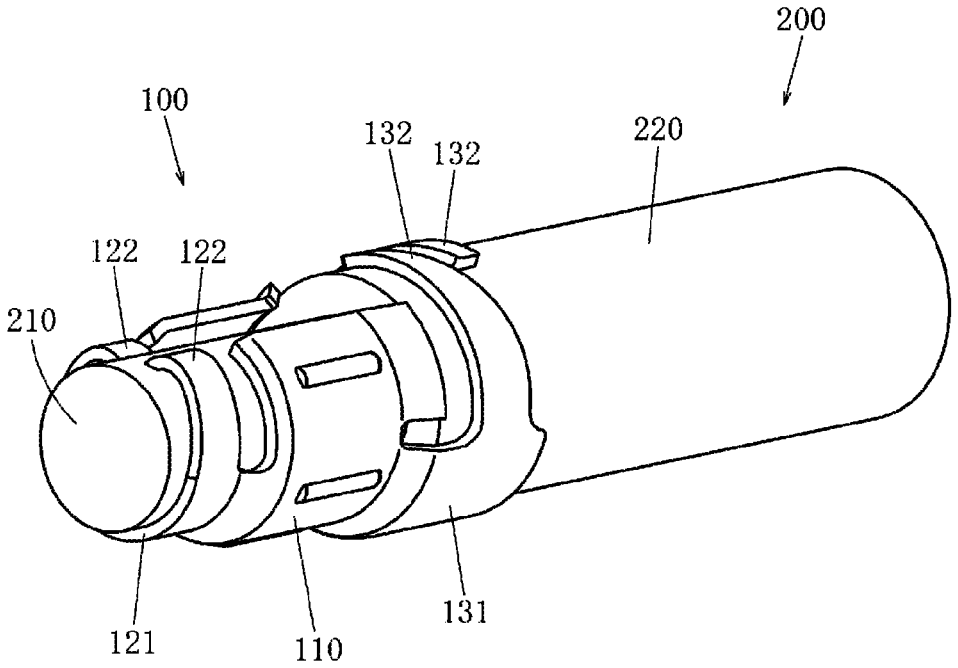
FIG. 22 is a perspective view illustrating a state in which the locking portions of the terminal according to the first variation related to the projecting portions have been crimped to the connected object.
Figure 24:
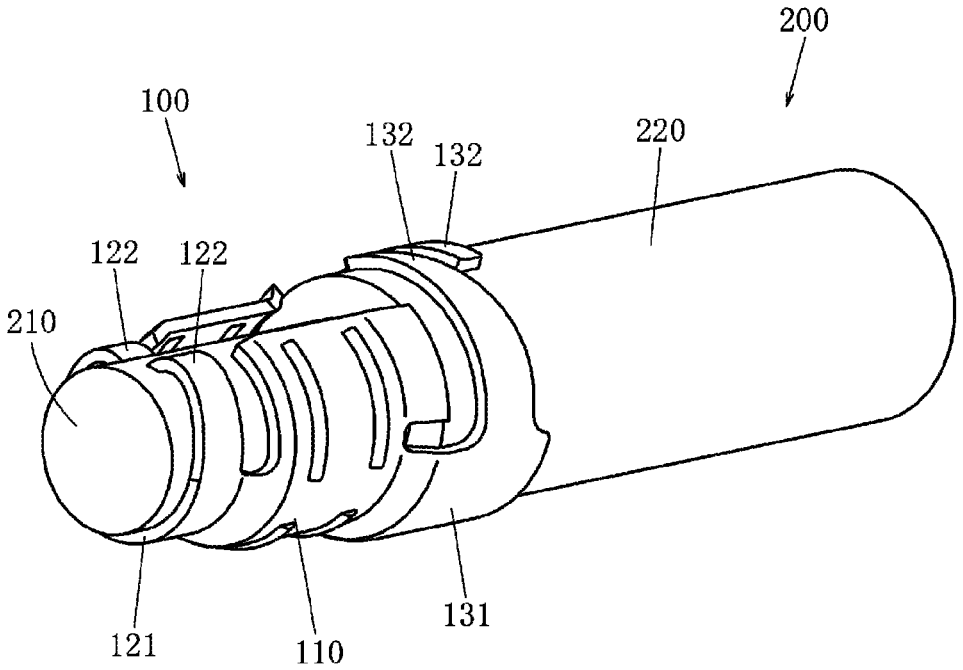
FIG. 24 is a perspective view illustrating a state in which the locking portions of the terminal according to the second variation related to the projecting portions have been crimped to the connected object.
Figure 26:
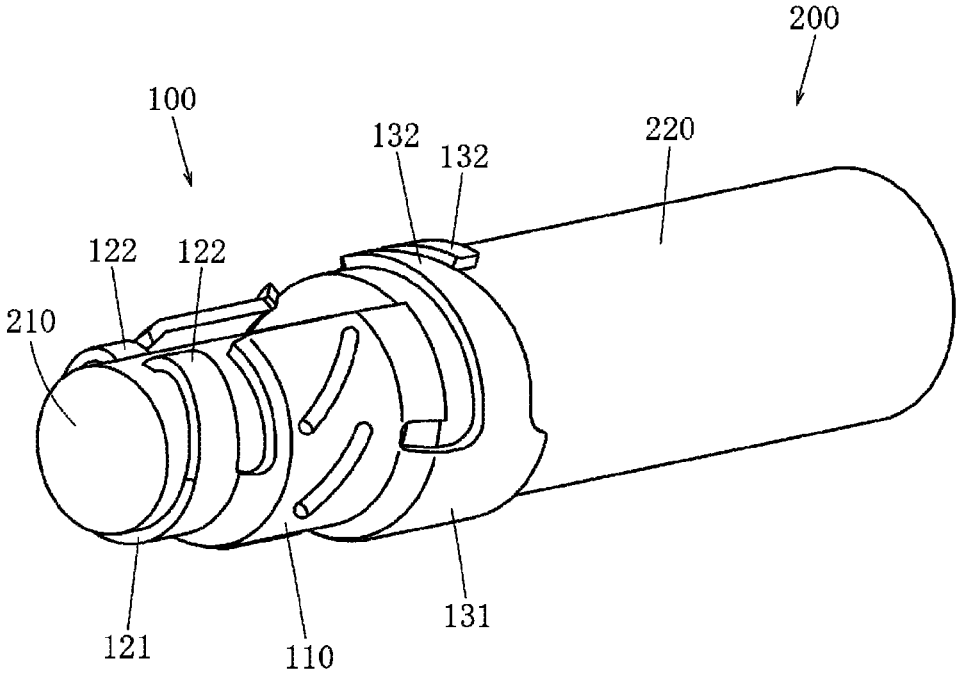
FIG. 26 is a perspective view illustrating a state in which the locking portions of the terminal according to the third variation related to the projecting portions have been crimped to the connected object.

The connected object 200 is an electric wire including a core wire serving as the conductor 210 and an insulating coating 220 covering the conductor 210. Accordingly, as shown in FIG. 10, the locking pieces 122 of the first locking portion 120 are configured to cling to the conductor 210 with a pressing force by being bent toward the inside and to be crimped to the conductor 210. The locking pieces 132 of the second locking portion 130 are configured to cling to the insulating coating 220 with a pressing force by being bent toward the inside and to be crimped to the connected object 200. In the terminal 100 according to the first variation related to the locking portions, as shown in FIG. 17, the first locking portions 120 are crimped to the conductor 210 of the connected object 200 in the same manner as shown in FIG. 10. In the terminal 100 according to the second variation related to the locking portions, as shown in FIG. 20, the second locking portions 130 are crimped to the connected object 200 in the same manner as shown in FIG. 10. In the terminals 100 according to the first to third variations related to the projecting portions, as shown in FIGS. 22, 24 and 26, respectively, the first locking portions 120 are crimped to the conductor 210 of the connected object 200 in the same manner as shown in FIG. 10, and the second locking portions 130 are crimped to the connected object 200 in the same manner as shown in FIG. 10. If the first locking portion or the second locking portion is the insulation-displacement type, the insulation-displacement blade 132*a* cuts into the insulating coating 220 of the connected object 200, and the connected object 200 is locked to the second locking portion 130. If the first locking portion or the second locking portion is the piercing type, the locking piece 132 pierces the insulating coating 220 and optionally also pierces the conductor 210, and thus the connected object 200 is locked to the second locking portion 130. The connected object 200 need only have a rod-shaped conductor, and includes, other than the electric wire, for example, a shielded cable or its components, for example, or a flat and flexible cable such as an FFC (flexible flat cable) or its components, for example, or another conducting means including a rod-shaped conductor. The connected object may be constituted by only the conductor.

As shown in FIGS. 11 to 14 and the like, in this embodiment, the mounting member 300 is a printed wiring board. The through hole 310 is provided so as to pass through the mounting member 300. A conductive member is provided in a range from the through hole 310 to the front surface and the back surface of the mounting member 300, and the conductive portion 320, which may be called a land in the printed wiring board, is constituted by the conductive member. Accordingly, the surface of the through hole 310 is formed by the conductive portion 320. The conductive portion need only be provided around the through hole such that a solder layer can be formed between the conductive portion and the body portion of the terminal when the body portion is fitted into the through hole, and need not be provided inside the through hole. This conductive portion 320 is made of a copper alloy, but the conductive portion 320 may be made up of another conductive member. The mounting member is not limited to the printed wiring board. The mounting member includes a casing or other members of an electrical product, for example. When the conductor 210 of the connected object 200 is connected to the terminal 100 and the body portion 110 of the terminal with the connected object is inserted and fitted into the through hole 310 of the mounting member 300, a gap 330 is formed between the body portion 110 and the wall 311 constituting the through hole 310, and a gap 115 is formed between the body portion 110 and the connected object 200, specifically, between the body portion 110 and the conductor 210. When the body portion 110 and the conductive portion 320 of the mounting member 300 are soldered, molten solder supplied from the front surface or the back surface of the mounting member 300 is absorbed into the gap 330 and solidifies to form a solder layer S1. Alternatively, when the conductor 210, the body portion 110, and the conductive portion 320 of the mounting member 300 are soldered, molten solder supplied from the front surface or the back surface of the mounting member 300 is absorbed into the gap 330 and solidifies to form a solder layer S1, and the molten solder is absorbed into the gap 115 and solidifies to form a solder layer S2. Such absorption of the solder from the front surface or the back surface of the mounting member 300 into the gaps 330 and 115 due to capillary action or the like is referred to using the expression "wetting of solder". The connected object 200 is mechanically and electrically connected to the mounting member 300 via the solder layers S1 and S2, and the like. The present invention encompasses an embodiment in which no solder layer is formed in the gap 115 between the body portion 110 and the connected object 200 in this manner. If the force with which the connected object is locked to the locking portion is sufficiently ensured, the strength of the mechanical and electrical connection between the connected portion and the mounting member may be sufficiently ensured even in such an embodiment.

Accordingly, the connected object 200 is connected to the terminal 100 by inserting the conductor 210 of the connected object 200 into the cylindrical space 111 of the body portion 110 and locking the connected object 200 with the locking portions 120 and 130. Then, the body portion 110 of the terminal with the connected object is inserted into the through hole 310 of the mounting member 300, and is fitted into the through hole 310. In this case, since the body portion 110 is formed in the major arc cylindrical shape or the overlapping cylindrical shape having elasticity and has the projecting portions 113 and 114, if the dimensions of the body portion 110 including the projecting portions 113 and 114 are controlled, the body portion 110 including the projecting portions 113 and 114 of the terminal with the connected object comes into contact with the wall 311 constituting the through hole 310 and is fitted into the through hole 310 with a predetermined fitting force. Therefore, in the fitting step, the terminal with the connected object stands on its own relative to the mounting member 300, and the gap 330 between the body portion 110 of the terminal with the connected object and the wall 311 constituting the through hole 310 is ensured by the projecting portions 113 and 114. Accordingly, in the soldering step, capillary action or the like facilitates the wetting of solder in the gap 330, and the solder layer S1 is favorably formed in the gap. When the solder layer S2 has been formed in the gap 115 between the body portion 110 and the connected object 200, it is possible to increase the force for connecting the body portion 110 and the connected object 200 due to the solder layer S2. This makes it possible to obtain stable strength of the mechanical and electrical connection between the connected object 200 and the mounting member 300. In the terminal 100 according to the embodiment, the body portion 110 was formed in the major arc cylindrical shape or the overlapping cylindrical shape having elasticity and was provided with the projecting portions 113 and 114 projecting toward the outside in this manner. This made it possible to provide a terminal with which the terminal 100 to which the connected object 200 is connected can be fitted into the through hole 310 provided in the mounting member 300 with a predetermined fitting force so that the terminal with the connected object stands on its own relative to the mounting member 300 and the gap 330 between the terminal with the connected object and the wall 311 constituting the through hole 310 is ensured in the fitting step, capillary action or the like can facilitate the wetting of solder in the gap 330 so that the solder layer S1 is favorably formed in the gap 330 in the soldering step, and stable strength of the mechanical and electrical connection between the connected object 200 and the mounting member 300 can be obtained.

In the terminal of the present invention, the body portion need only have at least one projecting portion projecting toward the outside, and there is no limitation on the number and the arrangement of the projecting portions of the body portion. Out of such various embodiments, in the terminals 100 according to the embodiment and the variations, three or more projecting portions 113 and 114 are provided, and three of these projecting portions 113 and 114 are provided at three positions that, if connected, form a triangle inside which the central axis C of the major arc cylindrical shape or the overlapping cylindrical shape is located, as viewed from the insertion direction. Accordingly, since the projecting portions 113 and 114 at the three positions come into contact with the wall 311 constituting the through hole 310, the body portion 110 can be positioned with respect to the wall 311. Therefore, in the fitting step, the terminal with the connected object stands on its own relative to the mounting member 300, and the gap 330 between the body portion 110 of the terminal with the connected object and the wall 311 constituting the through hole 310 is ensured by the projecting portions 113 and 114. Thus, in the soldering step, capillary action or the like facilitates the wetting of solder in the gap 330, and the solder layer S1 is favorably formed in the gap 330. This makes it possible to obtain stable strength of the mechanical and electrical connection between the connected object 200 and the mounting member 300. Since the projecting portions 113 and 114 at the three positions come into contact with the wall 311 constituting the through hole 310 in this manner, the body portion 110 can be positioned with respect to the wall 311, thus making it possible to more reliably obtain effects provided by the terminals 100.

Figure 32:
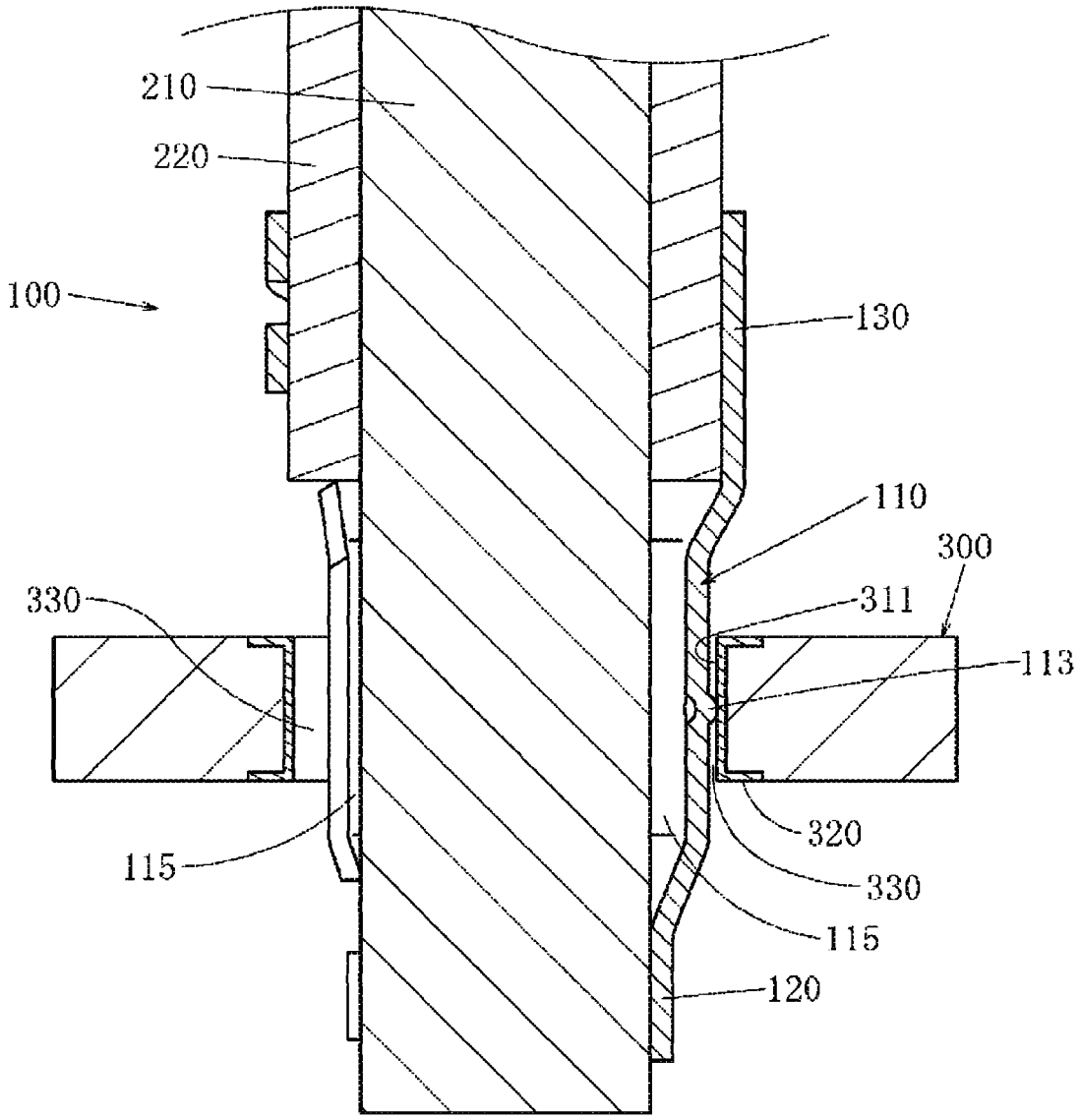
FIG. 32 is a diagram corresponding to FIG. 14, showing a terminal according to a fourth variation related to the projecting portions.

As described above, in the terminal of the present invention, the body portion need only have at least one projecting portion projecting toward the outside, and there is no limitation on the number and the arrangement of the projecting portions of the body portion. The shape of the projecting portion is not limited to those of the embodiment and the variations. The orientations of the side surfaces such as the surface of the projecting portion on the back side in the insertion direction and the surface thereof on the front side in the insertion direction may be freely determined, for example, and the orientations of the side surfaces may or need not be inclined with respect to the insertion direction, for example. As shown in FIG. 32 as an example, for example, in the case of the projecting portion 113 or the like that, when the body portion 110 is fitted into the through hole 310, comes into contact with and remains at an intermediate portion in the insertion direction of the wall 311 with a pressing force applied in the radial direction of the major arc cylindrical shape or the overlapping cylindrical shape, the orientations of the side surfaces may be freely determined, and the orientations of the side surfaces may or need not be inclined with respect to the insertion direction, for example. Out of such various embodiments, in the terminals 100 according to the embodiment and the variations, the first projecting portions 113 are provided on the back side in the insertion direction of the body portion 110, and the second projecting portions 114 are provided on the front side in the insertion direction thereof. The surface 113*a* of the first projecting portion 113 on the front side in the insertion direction is formed to be inclined toward the back side in the insertion direction as the surface 113*a* extends toward the outside, and the surface 114*a* of the second projecting portion 114 on the back side in the insertion direction is formed to be inclined toward the front side in the insertion direction as the surface 114*a* extends toward the outside. The distance D in the insertion direction between an intermediate portion in the projecting direction of the first projecting portion 113 on the surface 113*a* of the first projecting portion 113 on the front side in the insertion direction and an intermediate portion in the projecting direction of the second projecting portion 114 on the surface 114*a* of the second projecting portion 114 on the back side in the insertion direction is equal to the thickness T of the mounting member 300. Accordingly, when the body portion 110 of the terminal with the connected object is fitted into the through hole 310 of the mounting member 300, the surface 113*a* of the first projecting portion 113 on the front side in the insertion direction is locked to the circumferential edge portion of the opening of the through hole 310 on the back side in the insertion direction, and therefore, the terminal with the connected object is prevented from being easily pulled out from the through hole 310 of the mounting member 300. Moreover, since the surface 114*a* of the second projecting portion 114 on the back side in the insertion direction comes into contact with the circumferential edge portion of the opening of the through hole 310 on the front side in the insertion direction, the completion of a fitting operation is detected by the feedback sensation of the contact. Furthermore, a click sensation may be obtained when the first projecting portion 113 is elastically restored upon coming out of the through hole 310, for example.

The locking portions of the present invention may be any of the insulation-displacement type, the piercing type and another locking structure, for example. Out of such various embodiments, in the terminals 100 according to the embodiment and the variations, the locking pieces 122 and 132 are barrels that rise from at least one side out of the two sides in the width direction of the base pieces 121 and 131, respectively. Accordingly, the terminal 100 is connected to the conductor 210 by inserting the conductor 210 into the cylindrical space 111 of the body portion 110 and crimping the locking pieces 122 and 132 to the connected object 200.

A connection structure using a terminal of the present invention has been sufficiently disclosed by the above description. That is, the connection structure using a terminal of the present invention is a connection structure using a terminal that includes: the connected object 200 having the rod-shaped conductor 210; the mounting member 300 provided with the through hole 310; and the terminal 100 that includes: the body portion 110 having conductivity and elasticity, and being formed in the major arc cylindrical shape in which the central angle θi is greater than 180 degrees and the gap is formed between two edges in the circumferential direction or the overlapping cylindrical shape in which the two edges in the circumferential direction overlap each other, as viewed from the insertion direction, such that the cylindrical space 111 whose generating line extends in the insertion direction is formed inside the body portion 110; and the locking portions 120 and 130 being disposed on at least one side out of the back side and the front side in the insertion direction of the body portion 110, and having the base pieces 121 and 131 that extend from the body portion 110 toward the back side in the insertion direction or the front side in the insertion direction and the locking pieces 122 and 132 that is provided on the base pieces 121 and 131, the body portion having at least one projecting portion 113 or 114 projecting toward the outside, wherein the conductor 210 of the connected object 200 is inserted into the inside of the body portion 110 of the terminal 100 and is locked to the locking portions 120 and 130, the body portion 110 is fitted into the through hole 310 of the mounting member 300, and the projecting portions 113 and 114 are in contact with the wall 311 constituting the through hole 310, and the solder layer S1 is formed between the body portion 110 and the wall 311 constituting the through hole 310.

The connected object 200 is connected to the terminal 100 by inserting the conductor 210 of the connected object 200 into the cylindrical space 111 of the body portion 110 and locking the connected object 200 with the locking portions 120 and 130. Then, the body portion 110 of the terminal with the connected object is inserted into the through hole 310 of the mounting member 300 and fitted into the through hole 310. In this case, since the body portion 110 is formed in the major arc cylindrical shape or the overlapping cylindrical shape having elasticity and has the projecting portions 113 and 114, if the dimensions of the body portion 110 including the projecting portions 113 and 114 are controlled, the body portion 110 including the projecting portions 113 and 114 of the terminal with the connected object comes into contact with the wall 311 constituting the through hole 310 and is fitted into the through hole 310 with a predetermined fitting force. Therefore, in the fitting step, the terminal with the connected object stands on its own relative to the mounting member 300, and the gap 330 between the body portion 110 of the terminal with the connected object and the wall 311 constituting the through hole 310 is ensured by the projecting portions 113 and 114. Accordingly, in the soldering step, capillary action or the like facilitates the wetting of solder in the gap 330, and the solder layer S1 is favorably formed in the gap 330. This makes it possible to obtain stable strength of the mechanical and electrical connection between the connected object 200 and the mounting member 300.

In the connection structure using a terminal according to the embodiment, the body portion 110 of the terminal 100 was formed in the major arc cylindrical shape or the overlapping cylindrical shape having elasticity and was provided with the projecting portions 113 and 114 projecting toward the outside. This made it possible to provide a connection structure using a terminal with which the terminal 100 to which the connected object 200 is connected can be fitted into the through hole 310 provided in the mounting member 300 with a predetermined fitting force so that the terminal with the connected object stands on its own relative to the mounting member 300 and the gap 115 between the terminal with the connected object and the wall 311 constituting the through hole 310 is ensured in the fitting step, capillary action or the like can facilitate the wetting of solder in the gap 115 so that the solder layer S1 is favorably formed in the gap 115 in the soldering step, and stable strength of the mechanical and electrical connection between the connected object 200 and the mounting member 300 can be obtained.

The connection structure using a terminal of the present invention encompasses an embodiment in which no solder layer is formed between the body portion and the conductor of the connected object. Out of such various embodiments, in the connection structure using a terminal according to the embodiment and the variations, the solder layer S1 is formed between the body portion 110 and the wall 311 constituting the through hole 310, and the solder layer S2 is also formed between the body portion 110 and the conductor 210 of the connected object 200. Accordingly, the solder layer S2 improves the strength of the mechanical and electrical connection between the terminal 100 and the connected object 200, thus improving the strength of the mechanical and electrical connection between the connected object 200 and the mounting member 300.

Hereinafter, an overview of embodiments of the present invention will be described.

1) A terminal according to a first aspect of the present invention is a terminal that includes:

a body portion having conductivity and elasticity, and being formed in a major arc cylindrical shape in which a central angle is greater than 180 degrees and a gap is formed between two edges in a circumferential direction or an overlapping cylindrical shape in which two edges in the circumferential direction overlap each other, as viewed from an insertion direction, such that a cylindrical space whose generating line extends in the insertion direction is formed inside the body portion; and a locking portion being disposed on at least one side out of a back side and a front side in the insertion direction of the body portion, and having a base piece that extends from the body portion toward the back side in the insertion direction or the front side in the insertion direction and a locking piece that is provided on the base piece, wherein the body portion has at least one projecting portion projecting toward an outside.

The connected object is connected to the terminal by inserting the conductor of the connected object into the cylindrical space of the body portion and locking the connected object with the locking portion. Then, the body portion of the terminal with the connected object is inserted into the through hole of the mounting member and fitted into the through hole. In this case, since the body portion is formed in the major arc cylindrical shape or the overlapping cylindrical shape having elasticity and has the projecting portion, if the dimensions of the body portion including the projecting portion are controlled, the body portion including the projecting portion of the terminal with the connected object comes into contact with a wall constituting the through hole and is fitted into the through hole with a predetermined fitting force. Therefore, in the fitting step, the terminal with the connected object stands on its own relative to the mounting member, and a gap between the body portion of the terminal with the connected object and the wall constituting the through hole is ensured by the projecting portion. Accordingly, in the soldering step, capillary action or the like facilitates the wetting of solder in the gap, and a solder layer is favorably formed in the gap. This makes it possible to obtain stable strength of the mechanical and electrical connection between the connected object and the mounting member.

In the terminal according to the first aspect, the body portion of the terminal was formed in the major arc cylindrical shape or the overlapping cylindrical shape having elasticity and was provided with the projecting portion projecting toward the outside. This made it possible to provide a terminal with which the terminal to which the connected object is connected can be fitted into the through hole provided in the mounting member with a predetermined fitting force so that the terminal with the connected object stands on its own relative to the mounting member and the gap between the terminal with the connected object and the wall constituting the through hole is ensured in the fitting step, capillary action or the like can facilitate the wetting of solder in the gap so that the solder layer is favorably formed in the gap in the soldering step, and stable strength of the mechanical and electrical connection between the connected object and the mounting member can be obtained.

2) According to a second aspect of a terminal of the present invention, in the terminal according to the first aspect, in addition, three or more projecting portions are provided, and three of the projecting portions are provided at three positions that, if connected, form a triangle inside which a central axis of the major arc cylindrical shape or the overlapping cylindrical shape is located, as viewed from the insertion direction.

Accordingly, since the projecting portions at the three positions come into contact with the wall constituting the through hole, the body portion can be positioned with respect to the wall. Therefore, in the fitting step, the terminal with the connected object stands on its own relative to the mounting member, and the gap between the body portion of the terminal with the connected object and the wall constituting the through hole is ensured by the projecting portions. Thus, in the soldering step, capillary action or the like facilitates the wetting of solder in the gap, and the solder layer is favorably formed in the gap. This makes it possible to obtain stable strength of the mechanical and electrical connection between the connected object and the mounting member.

In the terminal according to the second aspect, the projecting portions at the three positions come into contact with the wall constituting the through hole, and therefore, the body portion can be positioned with respect to the wall, thus making it possible to more reliably obtain effects provided by the first terminal.

3) According to a third aspect of a terminal of the present invention, in the terminal according to the first or second aspect, in addition, a first projecting portion is provided on the back side in the insertion direction of the body portion and a second projecting portion is provided on the front side in the insertion direction, a surface of the first projecting portion on the front side in the insertion direction is formed to be inclined toward the back side in the insertion direction as the surface extends toward the outside, and a surface of the second projecting portion on the back side in the insertion direction is formed to be inclined toward the front side in the insertion direction as the surface extends toward the outside, and a distance in the insertion direction between an intermediate portion in a projecting direction of the first projecting portion on the surface of the first projecting portion on the front side in the insertion direction and an intermediate portion in a projecting direction of the second projecting portion on the surface of the second projecting portion on the back side in the insertion direction is equal to a thickness of a mounting member.

Accordingly, when the body portion of the terminal with the connected object is fitted into the through hole of the mounting member, the surface of the first projecting portion is locked to the circumferential edge portion of the opening of the through hole on the back side in the insertion direction, and therefore, the terminal with the connected object is prevented from being easily pulled out from the through hole of the mounting member. Moreover, since the surface of the second projecting portion comes into contact with the circumferential edge portion of the opening of the through hole on the front side in the insertion direction, the completion of the fitting operation is detected by the feedback sensation of the contact.

In the terminal according to the third aspect, it is possible to obtain effects provided by the terminal of the first or the second aspect, as well as to prevent the terminal with the connected object from being easily pulled out from the through hole of the mounting member, and to detect the completion of the fitting operation.

4) According to a fourth aspect of a terminal of the present invention, in the terminal according to any one of the first to the third aspects, in addition, the locking piece is a barrel that rises from at least one side out of two sides in a width direction of the base piece.

Accordingly, the terminal is connected to the conductor by inserting the conductor into the cylindrical space of the body portion and crimping the locking pieces to the connected object.

In the fourth terminal, it is possible to obtain effects provided by any one of the terminals according to the first to the third aspects, as well as to connect the terminal to the conductor by crimping the locking pieces to the connected object.

5) A connection structure using a terminal according to a first aspect of the present invention is a connection structure using a terminal that includes:

a connected object having a rod-shaped conductor;

a mounting member provided with a through hole; and a terminal that includes:

a body portion having conductivity and elasticity, and being formed in a major arc cylindrical shape in which a central angle is greater than 180 degrees and a gap is formed between two edges in a circumferential direction or an overlapping cylindrical shape in which two edges in the circumferential direction overlap each other, as viewed from an insertion direction, such that a cylindrical space whose generating line extends in the insertion direction is formed inside the body portion; and a locking portion being disposed on at least one side out of a back side and a front side in the insertion direction of the body portion, and having a base piece that extends from the body portion toward the back side in the insertion direction or the front side in the insertion direction and a locking piece that is provided on the base piece, the body portion having at least one projecting portion projecting toward an outside, wherein the conductor of the connected object is inserted into an inside of the body portion and is locked to the locking portion, the body portion is fitted into the through hole of the mounting member, and the projecting portion is in contact with a wall constituting the through hole, and a solder layer is formed between the body portion and the wall constituting the through hole.

The connected object is connected to the terminal by inserting the conductor of the connected object into the cylindrical space of the body portion and locking the connected object with the locking portion. Then, the body portion of the terminal with the connected object is inserted into the through hole of the mounting member and fitted into the through hole. In this case, since the body portion is formed in the major arc cylindrical shape or the overlapping cylindrical shape having elasticity and has the projecting portion, if the dimensions of the body portion including the projecting portion are controlled, the body portion including the projecting portion of the terminal with the connected object comes into contact with a wall constituting the through hole and is fitted into the through hole with a predetermined fitting force. Therefore, in the fitting step, the terminal with the connected object stands on its own relative to the mounting member, and a gap between the body portion of the terminal with the connected object and the wall constituting the through hole is ensured by the projecting portion. Accordingly, in the soldering step, capillary action or the like facilitates the wetting of solder in the gap, and a solder layer is favorably formed in the gap. This makes it possible to obtain stable strength of the mechanical and electrical connection between the connected object and the mounting member.

In the first connection structure using a terminal, the body portion of the terminal was formed in the major arc cylindrical shape or the overlapping cylindrical shape having elasticity and was provided with the projecting portion projecting toward the outside. This made it possible to provide a connection structure using a terminal with which the terminal to which the connected object is connected can be fitted into the through hole provided in the mounting member with a predetermined fitting force so that the terminal with the connected object stands on its own relative to the mounting member and the gap between the terminal with the connected object and the wall constituting the through hole is ensured in the fitting step, capillary action or the like can facilitate the wetting of solder in the gap so that the solder layer is favorably formed in the gap in the soldering step, and stable strength of the mechanical and electrical connection between the connected object and the mounting member can be obtained.

6) According to a second aspect of a connection structure using a terminal of the present invention, in the connection structure using a terminal according to the first aspect, in addition, a solder layer is formed between the body portion and the conductor of the connected object.

Accordingly, the solder layer improves the strength of the mechanical and electrical connection between the terminal and the connected object, thus improving the strength of the mechanical and electrical connection between the connected object and the mounting member.

In the second connection structure using a terminal, it is possible to obtain effects provided by the first connection structure using a terminal, as well as to improve the strength of the mechanical and electrical connection between the connected object and the mounting member.

The terminal and the connection structure using a terminal of the present invention encompass embodiments that are combinations of features of the above-described embodiment and variations. Furthermore, the above-described embodiment and variations are merely several examples of the terminal and the connection structure using a terminal of the present invention. Accordingly, the terminal and the connection structure using a terminal of the present invention is not intended to be limited by the descriptions of the embodiment and variations.

The invention claimed is:

1. A terminal comprising:

a body portion having conductivity and elasticity, and being formed in a major arc cylindrical shape in which a central angle is greater than 180 degrees and a gap is formed between two edges in a circumferential direction or an overlapping cylindrical shape in which two edges in the circumferential direction overlap each other, as viewed from an insertion direction, such that a cylindrical space whose generating line extends in the insertion direction is formed inside the body portion; and a locking portion being disposed on at least one side out of a back side and a front side in the insertion direction of the body portion, and having a base piece that extends from the body portion toward the back side in the insertion direction or the front side in the insertion direction and a locking piece that is provided on the base piece, wherein the body portion has at least one projecting portion projecting toward an outside.

2. The terminal according to claim 1, wherein three or more projecting portions are provided, and three of the projecting portions are provided at three positions that, if connected, form a triangle inside which a central axis of the major arc cylindrical shape or the overlapping cylindrical shape is located, as viewed from the insertion direction.

3. The terminal according to claim 2, wherein a first projecting portion is provided on the back side in the insertion direction of the body portion and a second projecting portion is provided on the front side in the insertion direction, a surface of the first projecting portion on the front side in the insertion direction is formed to be inclined toward the back side in the insertion direction as the surface extends toward the outside, and a surface of the second projecting portion on the back side in the insertion direction is formed to be inclined toward the front side in the insertion direction as the surface extends toward the outside, and a distance in the insertion direction between an intermediate portion in a projecting direction of the first projecting portion on the surface of the first projecting portion on the front side in the insertion direction and an intermediate portion in a projecting direction of the second projecting portion on the surface of the second projecting portion on the back side in the insertion direction is equal to a thickness of a mounting member.

4. The terminal according to claim 3, wherein the locking piece is a barrel that rises from at least one side out of two sides in a width direction of the base piece.

5. The terminal according to claim 2, wherein the locking piece is a barrel that rises from at least one side out of two sides in a width direction of the base piece.

6. The terminal according to claim 1, wherein a first projecting portion is provided on the back side in the insertion direction of the body portion and a second projecting portion is provided on the front side in the insertion direction, a surface of the first projecting portion on the front side in the insertion direction is formed to be inclined toward the back side in the insertion direction as the surface extends toward the outside, and a surface of the second projecting portion on the back side in the insertion direction is formed to be inclined toward the front side in the insertion direction as the surface extends toward the outside, and a distance in the insertion direction between an intermediate portion in a projecting direction of the first projecting portion on the surface of the first projecting portion on the front side in the insertion direction and an intermediate portion in a projecting direction of the second projecting portion on the surface of the second projecting portion on the back side in the insertion direction is equal to a thickness of a mounting member.

7. The terminal according to claim 6, wherein the locking piece is a barrel that rises from at least one side out of two sides in a width direction of the base piece.

8. The terminal according to claim 1, wherein the locking piece is a barrel that rises from at least one side out of two sides in a width direction of the base piece.

9. A connection structure using a terminal comprising:

a connected object having a rod-shaped conductor;

a mounting member provided with a through hole; and the terminal according to claim 1, wherein the conductor of the connected object is inserted into an inside of the body portion and is locked to the locking portion, the body portion is fitted into the through hole of the mounting member, and the projecting portion is in contact with a wall constituting the through hole, and a solder layer is formed between the body portion and the wall constituting the through hole.

10. The connection structure using a terminal according to claim 9, wherein a solder layer is formed between the body portion and the conductor of the connected object.

* * * * *